United States Patent [19]

Rooney

[11] 4,386,863

[45] Jun. 7, 1983

[54] PRINTER MECHANISM FOR TYPEWRITER

[75] Inventor: Craig E. Rooney, Prairie Village, Kans.

[73] Assignee: Engineering Research Applications, Leawood, Kans.

[21] Appl. No.: 377,797

[22] Filed: May 13, 1982

Related U.S. Application Data

[63] Continuation of Ser. No. 122,761, Feb. 19, 1980, abandoned.

[51] Int. Cl.[3] ..... B41J 23/34; B41J 23/36

[52] U.S. Cl. ..... 400/185; 400/376; 400/161.2; 400/146; 101/99; 101/111

[58] Field of Search ..... 400/185, 336, 336.1, 400/161.2, 146, 144.2; 101/93.18, 93.28, 93.30, 93.31, 99, 110, 111

[56] References Cited

U.S. PATENT DOCUMENTS

| | | | |
|---|---|---|---|
| 2,161,840 | 6/1939 | Adams | 400/144.2 X |
| 2,762,486 | 9/1956 | Lent | 197/49 |
| 3,164,084 | 1/1965 | Paige | 101/93 |
| 3,408,930 | 11/1968 | Chamness et al. | 101/93 |
| 3,584,722 | 6/1971 | Albrite | 197/158 |
| 3,677,386 | 7/1972 | Heterich et al. | 197/53 |
| 3,739,898 | 6/1973 | Rooney | 197/55 |
| 3,840,107 | 10/1974 | Mack et al. | 400/185 |
| 4,022,313 | 5/1977 | Lau et al. | 197/167 |
| 4,030,588 | 6/1977 | Hanagato et al. | 400/185 X |
| 4,030,591 | 6/1977 | Martin et al. | 400/144.2 X |
| 4,147,438 | 4/1979 | Sandrone et al. | 400/144.2 |
| 4,161,912 | 7/1979 | Usui et al. | 101/99 |
| 4,244,291 | 1/1981 | Kodaira et al. | 101/99 |
| 4,245,917 | 1/1981 | Mosciatti et al. | 400/144.2 |
| 4,249,829 | 2/1981 | Link et al. | 400/144.2 |

FOREIGN PATENT DOCUMENTS

| | | |
|---|---|---|
| 182504 | 3/1907 | Fed. Rep. of Germany . |
| 2755090 | 7/1978 | Fed. Rep. of Germany . |
| 1393558 | 1/1974 | United Kingdom . |

*Primary Examiner*—Edward M. Coven

*Attorney, Agent, or Firm*—Schmidt, Johnson, Hovey & Williams

[57] ABSTRACT

An improved, low cost, high speed, impact printing apparatus usable as a typewriter or as a machine printer is disclosed which includes a carriage translatable along a page through a rack and gear assembly and having an electronically controlled printing unit oriented to reveal the line of write and give constant printing characteristics independent of carriage speed. The printing unit includes a thin, lightweight, circular, bidirectionally shiftable, distensible synthetic resin band having printing characters thereon, along with a single, spring-powered impression hammer for selectively engaging and distending the band toward the page in order to print a selected character. Printing and letter-spacing are concurrently initiated and accomplished using only a single, windable, energy-storing mainspring and a mechanical energy transmission assembly coupling the rack and gear assembly and printer in parallel. The transmission assembly includes gearing for withdrawing a limited, predetermined amount of motive energy from the mainspring for each printing cycle, and for distributing such energy to achieve band spin and character selection, hammer cocking, and letterspacing translation of the carriage; after the variable amount of energy required for actual printing is determined (by the required band spin to achieve character selection) remaining withdrawn energy for the printing cycle is preferably used for increasing carriage speed, so that printing can occur at a variable but statistically very high speed (on the order of fifty characters per second or greater). During tab spacing, the character band and drive rotate and act as an airfoil governor to prevent attainment of undue, potentially destructive carriage translation speeds. Initiation and control of letterspacing, printing and tab spacing functions are achieved through appropriate logic circuitry coupling the keyboard or other input to a pair of solenoids, with mechanical linkages between the solenoid pair and transmission assembly.

25 Claims, 21 Drawing Figures

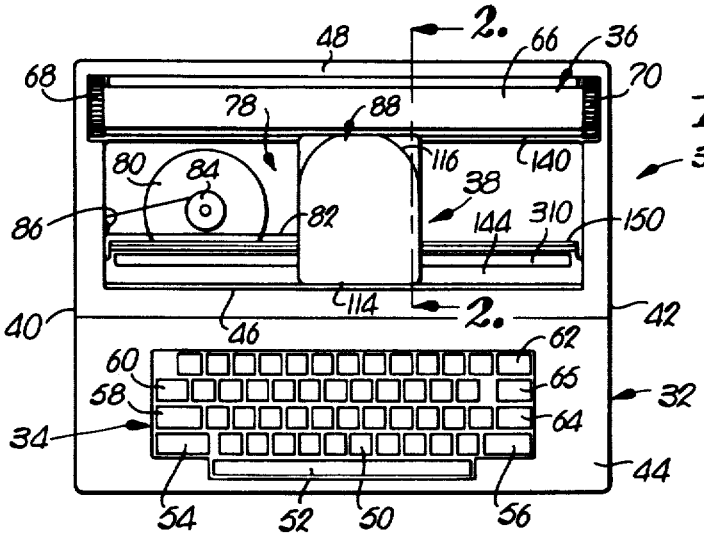
Fig.1.
Fig.5.
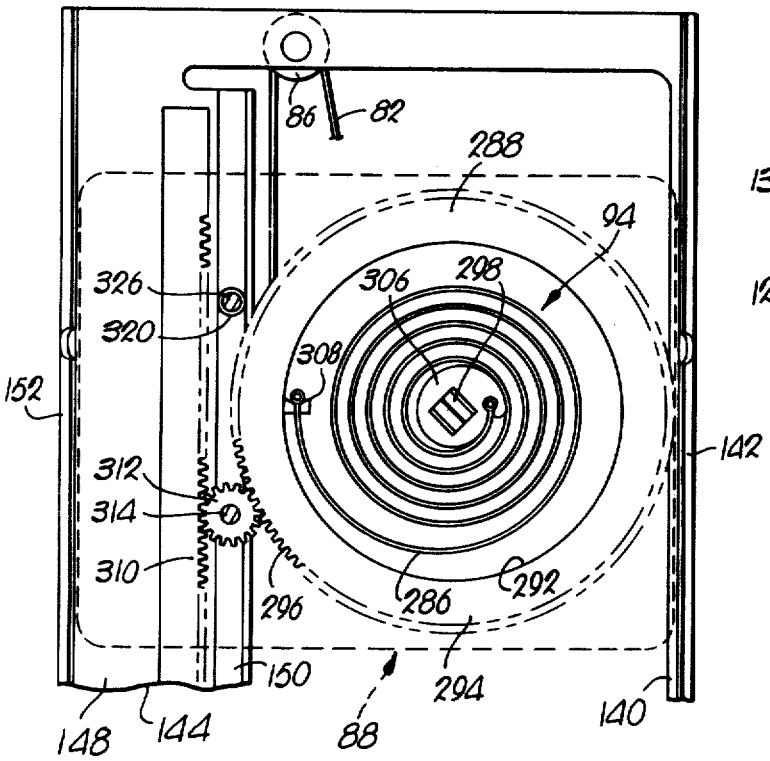
Fig.4.
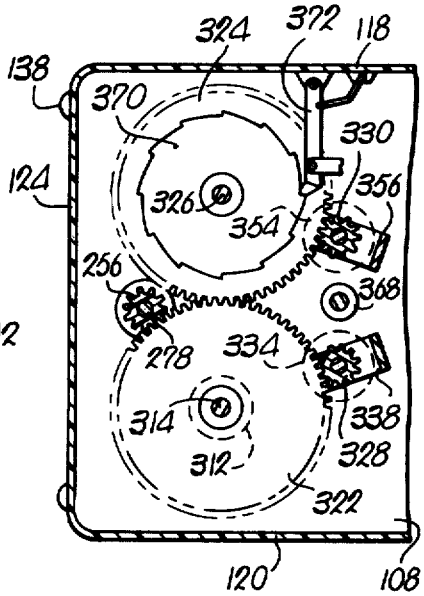

-102-
-104-
100
88
106
118
120
122
124
136
138
156
178
224
226
228
230
232
234
236
238
242
244
246
248
250
251
252
264
280
282
314
322
324
326
332
334
336
338
340
342
344
346
348
350
352
354
358
360
362
364
366
368
370
372
374
376
378
380
382
384
386
388
390
392
393
394
395
396
398
400
402
403
404
405
406
408
410
412
414
416
418
420
422
424
428
430
432
436
438
440
442
444
446
448
450
452
454
458
460
462
464

PRINTER MECHANISM FOR TYPEWRITER

This is a continuation of application Ser. No. 122,761, filed on Feb. 19, 1980, abandoned.

BACKGROUND OF THE INVENTION

1. Field of the Invention

The present invention is concerned with a greatly improved imprinting device capable of printing at very high speeds permitting the device to be used as a machine printer, while at the same time being sufficiently simple and low in cost that it can be employed as a conventional typewriter in a home or office. More particularly, it is concerned with such a device which accomplishes printing, word spacing and tab spacing using a single mainspring as a source of motive energy and in such manner that a limited energy quantum is withdrawn from the mainspring and distributed during each printing and/or spacing cycle in the most efficient manner. Energy distribution is effected such that energy remaining after the required energy for actual printing purposes is determined is employed to increase the speed of translation along the page; in this way a variable but statistically very high printing speed is obtained.

2. Description of the Prior Art

The typewriter art is highly developed and over a century old. At the outset of typewriter development, the devices were for the most part strictly mechanical typewriting machines of various degrees of complexity and sophistication. In more recent times these mechanical or manual machines have been largely replaced by electrically powered typewriters. In all cases however, the goal has been to achieve sufficient typing speed along with consistently good printing qualities.

With the advent of the electronic age, and particularly the development of high speed computers and information processing equipment, a need arose for a printing device having capabilities greatly different from those required of a conventional manual or electric typewriter. For example, while a fifteen character per second typing speed is more than adequate for a typewriter, this rate is exceedingly slow when contrasted with the output rates of computers or the like. In response to the need for high speed printing devices, a number of units have been proposed. Among these are dot printers, ink jet printers, chain printers, laser printers, daisy printers, modified electric typewriter printers, line printers and xerographic printers. While a number of these devices have achieved substantial commercial success for their intended function, they are in general characterized by a high degree of mechanical, electric and/or electronic complexity, and concomitant high cost. Further, most of these units are simply not realistically usable as a typewriter, inasmuch as they have poor printing quality, obscure the line of write as printing proceeds, or are incapable of making carbon copies.

In short, conventional manual or electric typewriters are adequate for normal typewriting and can be purchased at a reasonable cost, but are too slow or too expensive to convert to machine printers; on the other hand, printers developed specifically for coupling to remote input from computers, magnetic recordings, phone couplings or the like are in general far too expensive to justify use thereof as a typewriter, even if this were a functional possibility.

The problems outlined above have presented a serious obstacle to the spread of small computers and remote terminals linked to large central computers. Thus, while an individual or small company may be willing to invest in a small computer or terminal, the cost of a conventional machine printer as a part thereof may be such as to make the package price prohibitive. On the other hand, if a low cost typewriter/printer were available, the effect upon the spread of computer technology and other data processing equipment would be considerable.

Hence, there is a real and heretofore unsatisfied need in the art for a low cost, high speed printing device usable without modification either as a conventional typewriter or machine printer.

SUMMARY OF THE INVENTION

The present invention overcomes the problems noted above and provides a simplified, extremely low cost, high speed printing apparatus which can be interchangeably used without modification thereof as a normal typewriter or machine printer. To this end, the apparatus hereof is provided with a compact carriage assembly shiftable relative to a page or the like to be printed and carrying novel printing means. The functions of character printing and spacing (both letter-spacing and tab spacing) are activated and accomplished using quanta of potential energy stored in a single, windable mainspring likewise carried on the carriage. The apparatus of the invention is designed such that variable but very high carriage translation speeds can be attained, in order that the resultant typing speed is likewise very high for an impact printer (e.g., fifty characters per second or more depending upon text). At the same time, printing characteristics are uniform regardless of carrier speed or variances therein.

In more detail, the preferred form of the invention includes printing structure comprising printing means, and means (e.g., a rack and gear assembly) for effecting relative translatory movement between the printing means and the page being printed upon. The printing means has a shiftable, lightweight, distensible, shape-retaining band including a series of printing characters thereon, along with a selectively shiftable, over center impact member or hammer for engaging and distending the band towards the page for printing purposes. During each printing cycle, the hammer consumes a constant amount of energy, independent of carriage translation speed, in order to give consistent printing characteristics. On the other hand, the amount of energy consumed in the character selection process is variable and dependent upon the distance the band must shift in a given cycle. Thus, the total motive energy required by the printing means is variable.

An energy distributing transmission assembly couples the printing means and translation means. The transmission assembly serves to mechanically couple the printing means and translation means in parallel, and includes appropriate gearing for withdrawing a limited quantity of energy from the mainspring during each printing or spacing cycle, and for distributing this energy between the printing means and the translation means. Energy distribution is effected such that operation of the printing and translation means is commenced simultaneously and, after the total amount of energy required by the printing means is determined by the extent of band spin, remaining energy of the limited amount is expended in carriage movement. Thus when relatively little energy is consumed by band spin, carriage speed increases; conversely, when head spin consumes relatively more energy, carriage speed decreases. From a statistical standpoint however, average carriage speed in a given line of write is very high, thereby permitting use of the present invention as a machine printer.

During wordspacing or tab spacing cycles, the hammer is disengaged and no portion of the limited energy amount is expended on hammer movement. Such excess energy is supplied to the translation means with the effect that spacing speed is very high. In order to prevent the carriage from attaining very high, potentially destructive speeds during tab spacing, the band is spun during this operation and serves as a type of airfoil governor for limiting carriage translation speed.

Control for the printing structure of the invention is achieved through use of only two selectively operable solenoids, along with operating linkages connecting the solenoids and transmission assembly. Appropriate logic circuitry couples the solenoids and band position sensors with the keyboard or other input, in order to send control signals to the solenoids in response and corresponding to selection of a character to be printed or space to be formed.

BRIEF DESCRIPTION OF THE DRAWINGS

FIG. 1 is a plan view of a typewriter/printer in accordance with the invention;

FIG. 4 is a fragmentary sectional view illustrating portions of the gear transmission coupled between the mainspring and printing means of the invention;

FIG. 5 is a bottom view illustrating the energy-storing mainspring and the coupling thereof to the carriage-translating gear and rack assembly;

DESCRIPTION OF THE PREFERRED EMBODIMENT

Figure 2:
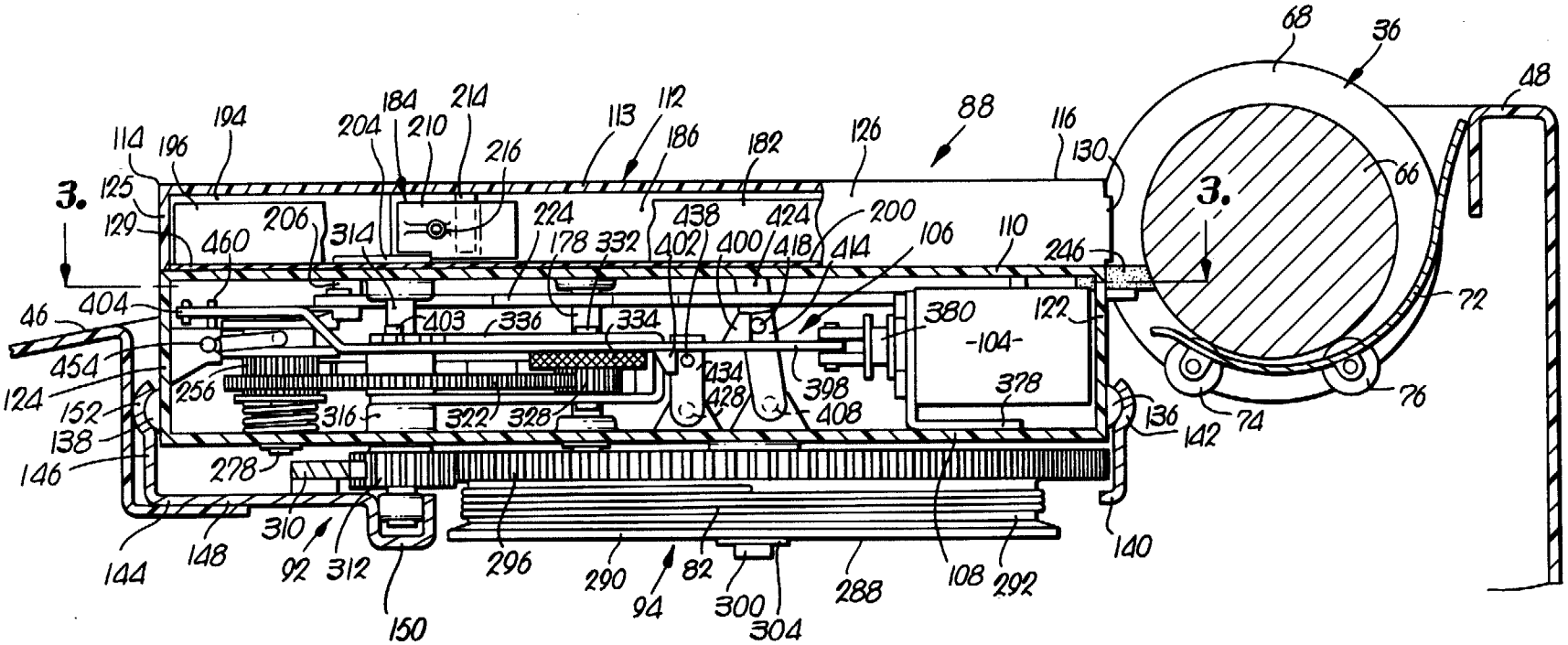
FIG. 2 is a fragmentary sectional view taken along line 2—2 of FIG. 1 which illustrates the details of construction of the shiftable carriage.

Turning now to the drawings, a printing apparatus 30 in accordance with the invention is illustrated in plan in FIG. 1. Broadly speaking, the apparatus 30 includes a conventional external casing 32, a multiple key keyboard 34 of known construction, an elongated, axially rotatable platen 36, and printing structure broadly referred by the numeral 38.

Casing 32 includes respective upright sidewalls 40, 42, an apertured, forward keyboard-receiving wall 44, and respective, elongated, spaced apart upper walls 46, 48 which cooperatively define an elongated, substantially rectangular opening therebetween for receiving platen 36 and printing structure 38.

Keyboard 34 is of the usual type and includes the necessary number of character selection keys 50, a single spacing bar 52, left and right shift keys 54, 56, a shift lock key 58, a tab spacing key 60, a backspacing key 62, a carriage return key 64, and, if desired, a separate paper advance or line feed key 65. As illustrated, the various operational keys are oriented in the usual manner, in order that apparatus 30 can be used as a normal typewriter. It will also become apparent in the ensuing discussion that other varieties of keyboards can be used in the apparatus of the present invention.

Platen 36 includes an elongated, cylindrical, rigid roller 66 having a pair of radially enlarged, endmost elements 68, 70. The platen 36 is mounted between sidewalls 40, 42 for axial rotation thereof. In addition, an elongated, arcuate, shiftable, paper guide 72 extends partially around roller 66 from wall 48 towards the forward region of the roller. The guide 72 carries a pair of elongated, paper-engaging rollers 74, 76, as is usual in constructions of this type. Guide 72 and the associated rollers 74, 76 are shiftable to a limited extent by the operator when the paper release lever (not shown) is actuated.

Printing structure 38 includes a carriage assembly 78, a selectively operable electric motor 80, and an elongated cable 82 operably coupling motor 80 and carriage assembly 78. Motor 80 is of conventional construction and includes a rotatable output spool 84 which rotates in a clockwise direction upon actuation of motor 80. The cable 82 is secured to spool 84 for windup thereon, and is threaded about a guide pulley 86 mounted on sidewall 40 (see FIG. 1). The remaining end of cable 82 is operatively secured to the carriage assembly 78 in a manner to be made clear hereinafter.

Carriage assembly 78 broadly includes a housing 88 which is substantially rectangular in plan configuration, along with printing means 90 carried within housing 88, translation means 92 for selective translatory movement of housing 88 and printing means 90 along the length of platen 36, motive means 94, and energy transmission and distribution means 96 operably coupling motive means 94 and printing means 90. Control assembly 100 is also provided and includes first and second operating solenoids 102, 104, appropriate electrical control circuitry 500 (see FIG. 21), and a linkage assembly 106 operably coupled between the solenoids 102, 104 and printing means 90 and translation means 92.

Housing 88 includes a bottom wall 108, an intermediate wall 110, and a removable upper head section 112. The walls 108, 110 are substantially rectangular in configuration, whereas upper head section 112 presents a top wall 113 having a rectilinear forward edge 114, and an arcuate rearward edge 116. Respective, spaced apart sidewalls 118, 120, a rear wall 122, and a front wall 124 extend between and interconnect the bottom wall 108 and intermediate wall 110 to define a lower chamber in housing 88. A pair of upper sidewall sections 126, 128 (see FIG. 9), and an upper front wall section 125 are respectively secured to and depend from top wall 113. A forward bottom wall 129 is secured between sections 126, 128 to define therewith a ribbon chamber. The sidewall sections 126, 128 are arcuate and conform to edge 116 of top wall 113. Further, each of these upper sidewall sections includes an inwardly extending, yieldable, shape-retaining flap 130, 132 which is free of connection to the walls 110 and 113. The flaps 130, 132 extend towards each other in an opposed relationship, and cooperatively define therebetween a printing aperture 134. The purpose of aperture 134, and the operation of the flaps 130, 132, will be explained in detail hereinafter.

Figure 3:
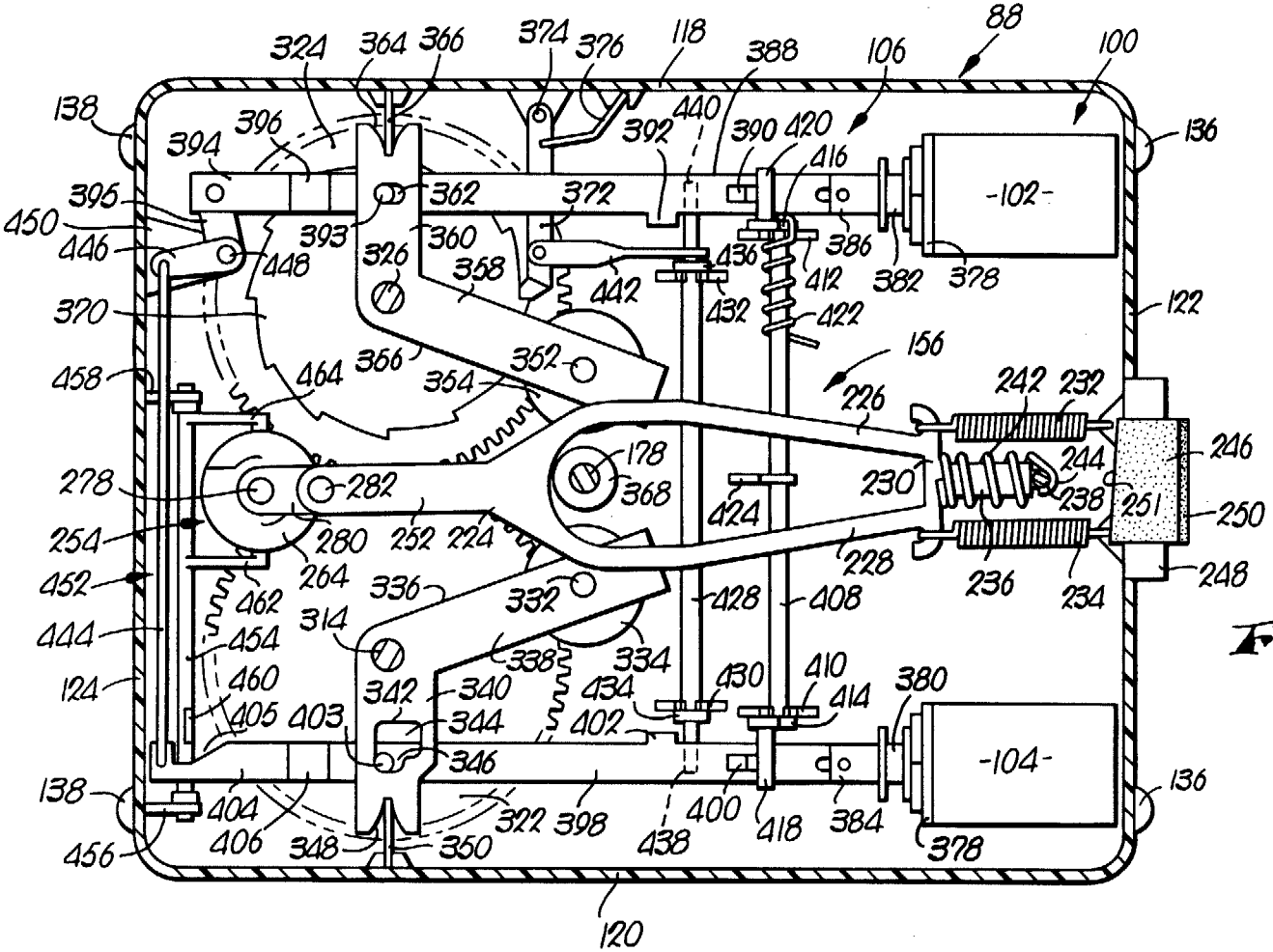
FIG. 3 is a sectional view taken along line 3—3 of FIG. 2.

Referring to FIGS. 2 and 3, it will be observed that the walls 122 and 124 each have a pair of spaced apart, outwardly extending, rounded guide nibs 136, 138 thereon. A rear guide wall 140 extends between the sidewalls 40, 42 and is configured to present an elongated concavity 142 along the length thereof which shiftably receives the nibs 136. In a similar fashion, an elongated, forward guide wall 144 is secured between sidewalls 40, 42 and presents an upstanding portion 146, a rearwardly extending portion 148, and a rearmost, elongated, U-shaped channel 150. Upstanding portion 146 is provided with an elongated concavity 152 similar to concavity 142 which receives the guide nibs 138.

Figure 6:
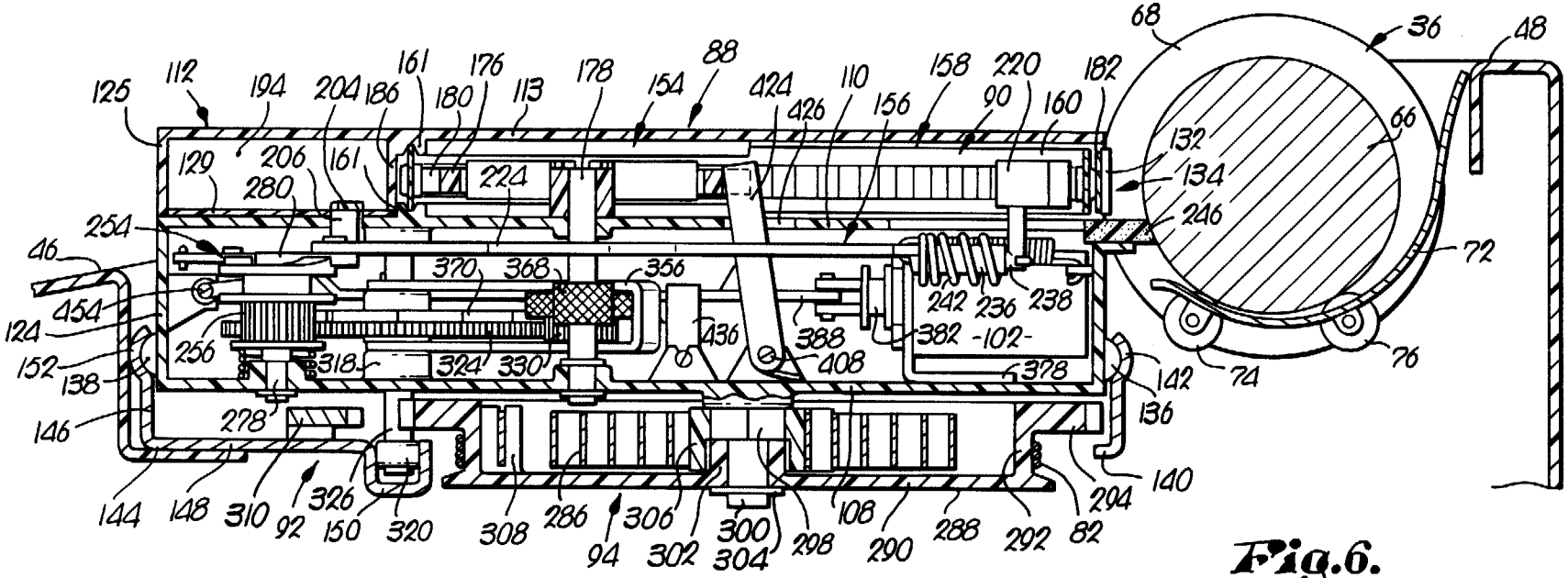
FIG. 6 is a fragmentary view taken substantially along the center line of the carriage assembly, with portions of the structure depicted in elevation and other portions in sections.
Figure 14:
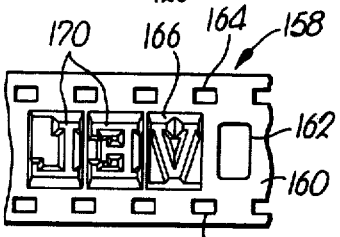
FIG. 14 is an elevational view similar to that of FIG. 12 but depicting the opposite side of the band.
Figure 13:
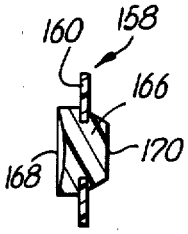
FIG. 13 is a sectional view taken along 13—13 of FIG. 12.
Figure 12:
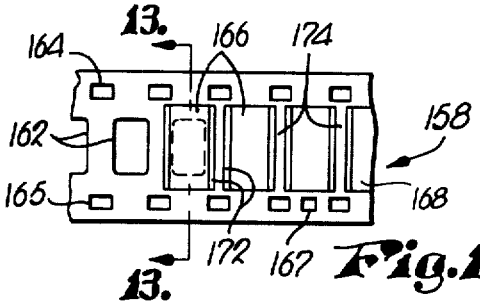
FIG. 12 is a fragmentary elevational view of the band depicted in FIG. 11.

Printing means 90 in general includes a head assembly 154 housed within the upper portion 112 of housing 88 between intermediate wall 110 and upper wall 113, and an impacting assembly 156 disposed within the upper and lower portions of the housing. The head assembly 154 includes an elongated, circular, shiftable band element 158 (see FIGS. 9–14). The band loop is in the form of an elongated, continuous, circular strip 160 of flexible, synthetic resin material which exhibits plastic memory and is rotatably supported on upper and lower bifurcated guides 161 respectively extending from top wall 113 and intermediate wall 110 (FIG. 6). The strip 160 is provided with a series of spaced, juxtaposed, character-receiving openings 162 along the length thereof, as well as structure such as secondary apertures 164 and a third series of apertures 165 including an "extra" indexing aperture 167, which serve as position indicating means for the band element. Separate character bodies 166 are mounted in the respective openings 162 and present opposed impact and printing faces 168, 170. The character faces 170 are three-dimensional and are configured to present appropriate printing characters such as the letters illustrated in FIG. 14. It will also be observed that the bodies 166 are substantially thicker than the strip 160, and present arcuate in cross section impact faces 168. Moreover, in preferred forms of the invention, the bodies 166 are substantially more rigid than the strip 160, and further the character faces thereof may be metal plated if desired. Finally, as best seen in FIG. 11, the adjacent, inwardly extending sidewalls 172 of the juxtaposed character bodies 166 cooperatively define somewhat triangular spaces 174 between the character bodies. The importance of these features of band element 158 will be made clear hereinafter.

Preferably, the strip 160 is formed of a polypropylene material, whereas the bodies 166 are formed of a fiberglass filled polycarbonate material. In other embodiments, the band element 158 could be formed of an appropriate metallic material, or as a metal-synthetic resin composite.

Head assembly 154 further includes a band drive gear 176 which is rotatably mounted to an upright shaft 178 passing through the intermediate wall 110. The gear 176 is provided with teeth 180 designed to operatively mesh with the band 158, and particularly the spaces 174 thereof between adjacent character bodies 166. Thus, rotation of the gear 176 through shaft 178 serves to correspondingly rotate the band element 158.

Figure 8:
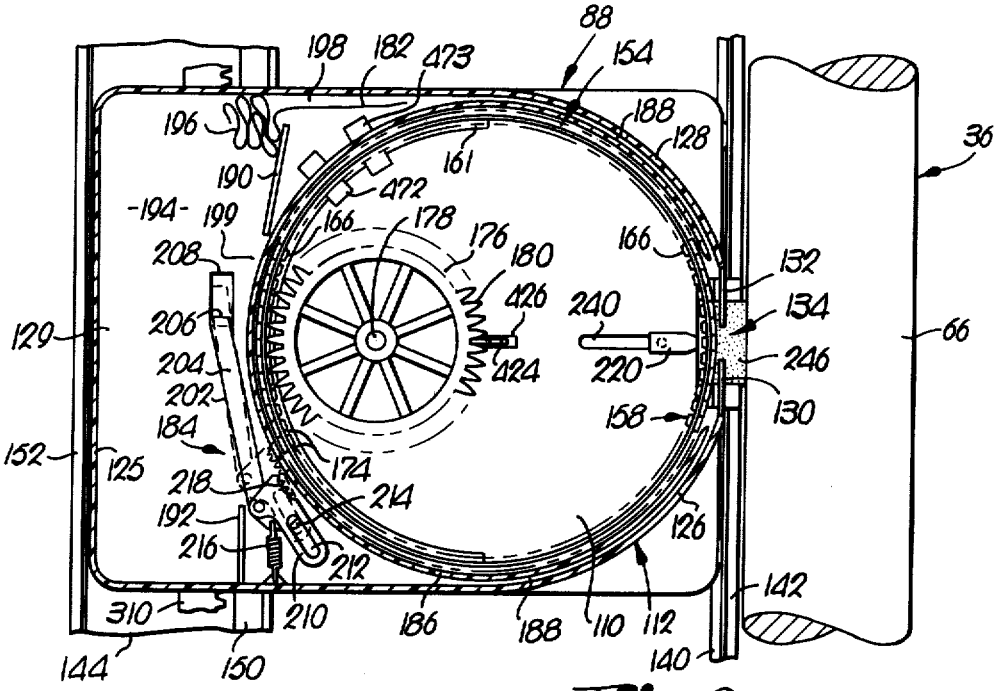
FIG. 8 is a fragmentary view in partial section illustrating the upper head portion of the carriage assembly.
Figure 9:
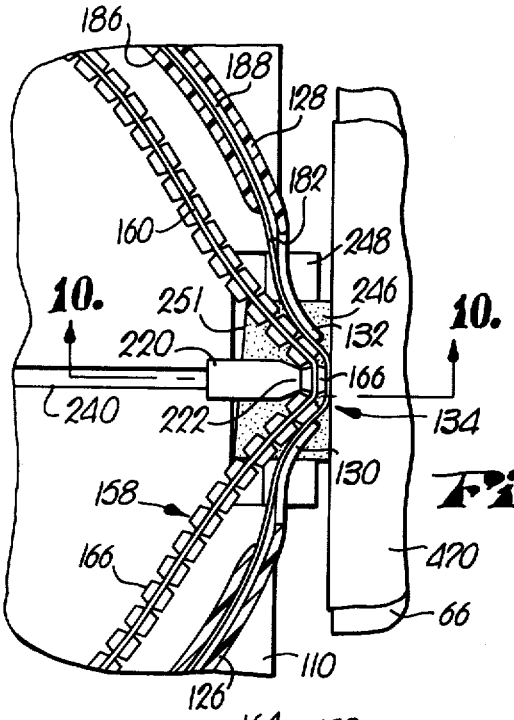
FIG. 9 is an enlarged, fragmentary view illustrating the character printing operation wherein the impact hammer engages the distensible, character-bearing band and distends the same towards a page for printing purposes.

A typing ribbon 182 and ribbon advance assembly 184 also form a part of head assembly 154. In more detail, the assembly 184 includes a continuous, arcuate guide wall 186 which depends from top wall 113 and is oriented to fit within the sidewall sections 126, 128 so as to define therebetween a narrow ribbon passageway 188. As best seen in FIGS. 8 and 9, the opposed ends of guide wall 186 extend to points proximal to the respective flaps 130, 132. It will also be seen that the band element 158 is positioned in closely spaced relationship to the inner face of guide wall 186.

Secondary, ribbon chamber-defining walls 190, 192 are also secured to top wall 113 and extend downwardly therefrom. These walls cooperate with walls 113, 125, 126, 128 and 129 to present a ribbon chamber 194 for holding a supply 196 of the ribbon 182 (see FIG. 2). Note in this regard that an entrance space 198 is provided between the wall 190 and section 128 for passage of ribbon from the supply 196 into and through the passageway 188, and that an exit space 199 for the ribbon is likewise presented between the inner ends of walls 190 and 192. Travel of the ribbon 182 into, along the length of, and out of passageway 188 is facililitated by provision of an upstanding, ribbon-supporting ridge 200 on wall 110 at the region where the ribbon traverses passageway 188.

The advancing mechanism 184 also includes a spring biased cam advancer 202 disposed within chamber 194 having an elongated arm 204 terminating in a depending operating tab 206. The tab 206 extends through a slot 208 provided in walls 129 and 110 for purposes to be made clear. The lowermost end of arm 204 as viewed in FIG. 8 is pivotally coupled to a block 210 having a slot 212 therein. A limit pin 214 connected to top wall 113 and extending downwardly therefrom is received within slot 212. A return spring 216 is operatively connected between the upper sidewall section 126 and block 210 as illustrated. Finally, the face of block 210 closest to guide wall 186 is provided with a series of ribbon-engaging teeth 218.

Impacting assembly 156 includes a shiftable hammer 220 having a rearmost work end 222 adapted to engage the impact-receiving faces 168 of character bodies 166. The hammer 220 is disposed within upper chamber 112 of housing 88 at the same vertical level as the band element 158 (see FIG. 10).

Drive for the hammer 220 is accomplished through an elongated, bifurcated element 224 having spaced apart legs 226, 228 joined at the rearward end thereof by means of a crosspiece 230. A pair of secondary hammer drive springs 232, 234 are connected between crosspiece 230 and rear wall 122 of the housing 88. A rearwardly extending, tubular guide 236 is also secured to crosspiece 230 between the springs 232, 234. An L-shaped guide rod 238 is secured to the underside of hammer 220 and extends into tubular guide 236. For this purpose, intermediate wall 110 of housing 88 is slotted as at 240 to accommodate guide rod 238 and permit back-and-forth shifting of hammer 220 as will be described. A hammer return spring 242 is operatively disposed about tubular guide 236 and is in engagement with the rearmost end of guide rod 238 as at 244.

The impacting assembly 156 further includes an elongated, laterally shiftable energy-absorbing pad 246 of synthetic resin foam material which is oriented for engagement by the upstanding portion of guide rod 238 as hammer 220 shifts rearwardly for printing purposes. The pad 246 is supported on a ledge wall 248 extending rearwardly from the upper margin of rear wall 122 (see FIG. 10). It will be observed that the pad 246 has an arcuate rearmost edge 250 configured to conform to the radius of curvature of roller 66, and a slanted, forward hammer-engaging face 251.

The forward end of the element 224 is in the form of an elongated tang 252. The tang 252 is pivotally coupled to a hammer cocking mechanism 254. Specifically, the mechanism 254 includes an upright hammer gear 256 having a pair of radially enlarged plates 258, 260 respectively disposed across the top and bottom margins thereof. A radially constricted body portion 262 is connected to an extends upwardly from plate 258, and has an operating plate 264 connected to and extending across the top thereof. In this fashion an annular zone 266 is defined between the plates 258, 264; the purpose of this zone 266 will be explained hereinafter.

The upper surface of operating plate 264 is provided with a pair of upstanding cam surfaces 270, 272. Each of these cam surfaces terminates in a vertical abutment surface 274, 276 (see FIGS. 16 and 19). An elongated, upright, axially rotatable operating shaft 278 is secured to housing wall 108 and extends centrally through a boss 279 on wall 108 and thence through gear 256, plate 258, body portion 262 and plate 264. The shaft and components thereon are cooperatively splined for rotation of the gear, body portion and plates with the shaft, while permitting selective vertical movement of these components. A link 280 is secured to the uppermost end of shaft 278 for rotation therewith, but this link does not vertically reciprocate with the gear 256, body portion 266, and plates 258, 264. The link 280 extends laterally from shaft 278 and is pivotally connected to the forwardmost end of tang 252 as at 282.

A coiled spring 284 is disposed between the underside of plates 260 and housing wall 108 about boss 279. This spring serves to bias operating plate 264 to the uppermost, hammer-cocking position thereof illustrated in FIG. 16.

Motive means 94 is in the form of a single, windable, coiled mainspring 286. The mainspring 286 is disposed within a rotatable housing 288 having a circular, peripherally flanged bottom wall 290, an upstanding, continuous circular sidewall 292, and an uppermost, radially outwardly extending gear flange 294 having a series of gear teeth 296 thereon. Housing 288 is rotatably secured to the underside of bottom wall 108. For this purpose, the wall 108 is provided with a depending, stationary stud having a polygonal section 298 and a cylindrical section 300. The bottom wall 290 of housing 288 is provided with a central, inwardly extending boss 302 which fits over and rotates relative to the cylindrical stud section 300. A retainer clip 304 serves to hold housing 288 in position on the stationary stud.

The innermost end of coiled mainspring 286 is fixedly secured to a stationary block 306 connected to polygonal stud section 298 (see FIG. 5). On the other hand, the outermost end of the spring 298 is secured to the inner face of circular sidewall 292, by means of an appropriate retainer 308. The end of rewind cable 82 remote from motor 80 is secured to the outer face of circular sidewall 292 so as to allow the cable to wind thereon during printing and spacing operations in the manner to be described.

Translation means 92 includes an elongated, toothed rack 310 mounted on rearwardly extending portion 148 of guide wall 144 and extending between the casing sidewalls 40, 42. A pinion or rack gear 312 is in operative engagement with rack 310, and with the gear teeth 296 of flange 294 (see FIG. 20). The rack gear 312 is secured to an upwardly extending, rotatable shaft 314 which extends through bottom wall 108 and is supported by a bushing 316. The shaft 314 further extends above the bushing structure 316 for purposes to be explained. A second translation guide in the form of an elongated, depending shaft 326 extends through bottom wall 108, is supported by bushing 318, and has a radially enlarged guide element 320 thereon. The element 320 rides in the U-shaped channel 150 for guiding the translatory movement of the housing 88 during printing and spacing operations. Shaft 326 extends upwardly from bushing 318 and is journaled in a boss, secured to wall 110.

Figure 7:
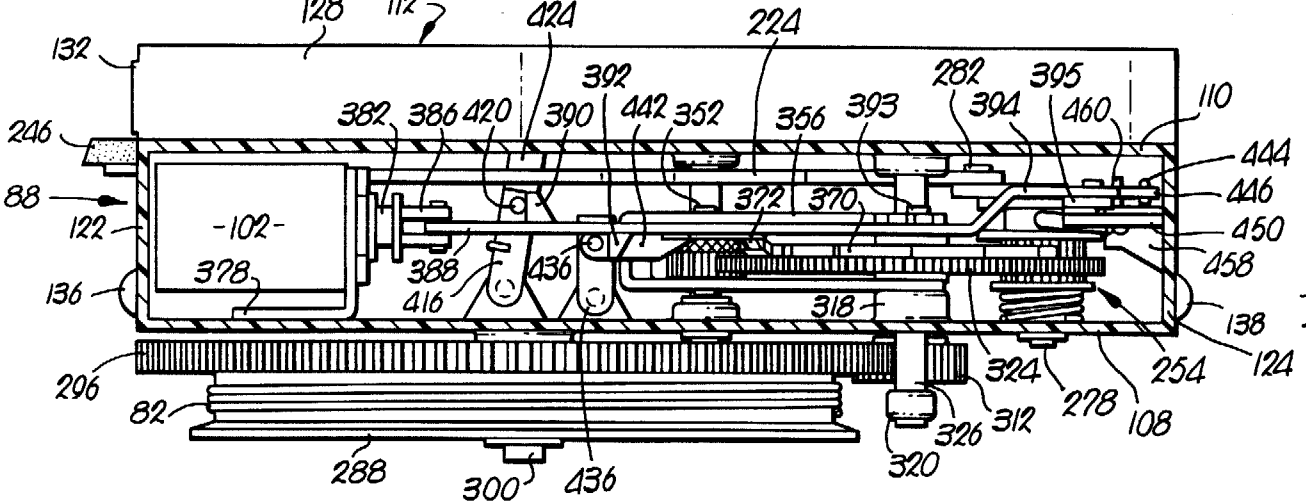
FIG. 7 is a view similar to that of FIG. 2 but illustrating the internal construction of the carriage assembly, viewed from the side opposite that of FIG. 2.
Figure 16:
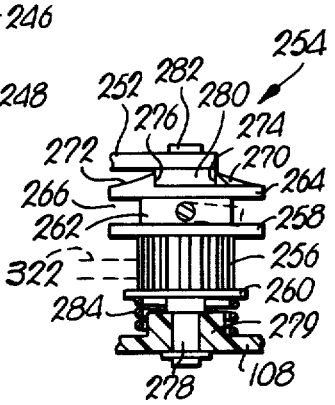
FIG. 16 is a fragmentary sectional view depicting the orientation of the hammer drive assembly during the character-printing cycle illustrated in FIG. 15.
Figure 19:
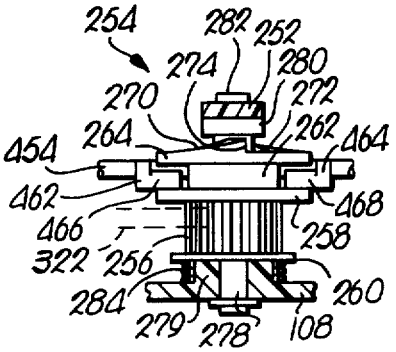
FIG. 19 is a sectional view similar to that of FIG. 16, and depicting the operation of the hammer drive assembly during the spacing cycle depicted in FIG. 18.

Energy transmission and distribution means 96 includes, in addition to the gear flange 294 and rack gear 312, mechanical gearing operably connecting in parallel the printing means 90 and the translating means 92, i.e., to rack gear 312. In detail, the means 96 includes first and second, peripherally toothed sun gears 322, 324 which are maintained in meshed, driving engagement with each other. The gear 322 is mounted for rotation on rack gear shaft 314, whereas gear 324 is supported on rotatable shaft 326 secured between bottom wall 108 and intermediate wall 110 (see FIG. 7). The hammer gear 256 is maintained in operative, driven engagement with the gear 322 as best seen in FIGS. 4, 16 and 19; it will also be observed that gear 256 is significantly thicker than the gear 322.

The transmission and distribution means 96 further includes a pair of plant gears 328, 330 respectively in meshed, driven engagement with the corresponding sun gears 322, 324. The planet gear 328 is secured to a rotatable shaft 332, the latter also having a friction gear 334 thereon above planetary gear 328. The gears 328, 334 are maintained in planetary relationship relative to sun gear 322 by means of a link 336 which is somewhat L-shaped in plan configuration. It will be noted in this respect that the link 336 includes a first, U-shaped radial portion 338 between and operatively coupling the shafts 314 and 332, with the spaced apart legs of the portion 338 rotatably supporting the gear shaft 332 and being pivotal about shaft 314. A second radial portion 340 extends from the upper leg of portion 338 towards sidewall 120. This radial portion 340 is configured to present an irregular aperture 342 therethrough having an enlarged slot-like region 344, as well as a somewhat smaller, arcuate region 346. The outermost end of second radial portion 340 is notched as at 348 and receives a flexible, motion-limiting leaf spring 350. The spring 350 is secured to wall 20 as illustrated.

Planet gear 330 is likewise supported on a rotatable shaft 352 carrying a friction gear 354 above the planet gear. A link 356 including a first U-shaped radial portion 358 extends from and is pivotal to shaft 326, and rotatably supports gear shaft 352 at the outer, closed end thereof. A second radial portion 360 extends from the upper leg or portion 358 towards wall 118. Link 356 is pivotal about shaft 326, and the portion 360 thereof is slotted as at 362. Finally, the outer most end of portion 360 is notched as at 364, and receives a flexible, motion-limiting leaf spring 366. The latter is secured to sidewall 118 as depicted. It will be noted that slot 362 is of a different configuration than the aperture 342 of link 336.

The transmission and distribution means 96 also includes a central friction gear 368 which is disposed between and alternately engageable by the friction gears 334, 354. Viewing FIG. 6, it will be observed that the central friction gear 368 is mounted for rotation on head gear shaft 178 which extends through intermediate wall 110 for this purpose. The lowermost end of the shaft 178 is rotatably secured to bottom wall 108 in the known manner.

The preferred energy transmission and distribution means in accordance with the invention includes mechanism for withdrawing only a limited quantum or amount of energy from the spring 286 during each printing or spacing cycle. Such mechanism includes a peripherally toothed ratchet wheel 370 mounted for rotation on shaft 326 atop sun gear 324 but below the link 356. A cooperable pawl 372 also forms a part of this mechanism. The pawl 372 is pivotally attached to wall 118 as at 374. A motion-limiting biasing leaf spring 376 of somewhat V-shaped configuration is also secured to wall 118 and to pawl 372 as illustrated. When pawl 372 is oriented in its FIG. 20 position in engagement with a tooth on wheel 370, rotation of the gears of assembly 96 is precluded.

As noted above, control assembly 100 includes respective solenoids 102, 104, as well as appropriate electrical control circuitry 500 later to be described. The solenoids 102, 104 are conventional and are respectively secured to bottom wall 108 by means of L-shaped mounts 378. Each of the solenoids includes a reciprocable plunger 380, 382 presenting a bifurcated connection end 384, 386.

Linkage assembly 106 serves to operably couple the solenoids 102, 104 to the energy transmission and distribution means 96. This assembly 106 includes an elongated linkage arm 388 secured to connection end 386 of plunger 382. The arm 388 (see FIG. 7) includes an upstanding projection 390 closest to plunger 382, a depending nib 392 spaced from projection 390, a pin 393 disposed within aperture 362, and an endmost vertically offset portion 394 adjacent and in front of the second radial portion 360 of the link 356. The portion 394 and the main body of linkage arm 388 are connected by an angular section 396. The extreme forward end of portion 394 is coupled to a transversely extending link 395 (FIG. 3).

A linkage arm 398 similar in most respects to arm 388 is pivotally secured to and extends forwardly from connection end 384 of plunger 380. The arm 398 includes an upstanding projection 400, a depending nib 402, a pin 403 disposed within slot 342, and a vertically offset forward portion 404 connected to the main arm by means of an angular section 406. However, the forward end of portion 404 is notched as at 405.

An elongated, pivotally mounted, tine-supporting rod 408 extends transversely between the arms 388, 398. The rod 408 is pivotally supported beneath the linkage arms 388, 398 by means of respective mounts 410, 412 secured to wall 108. Upwardly extending arms 414, 416, are respectively mounted on the opposed ends of rod 408 for pivoting therewith. Elongated, oppositely laterally extending elements 418, 420 are respectively secured to the uppermost ends of the corresponding arms 414, 416; the elements are disposed rearwardly of and adjacent to the projections 390, 400, on the linkage arms 388, 398. A biasing spring 422 is disposed about rod 408 adjacent mount 412, and serves to bias the rod 408 to the FIG. 2 position thereof. An elongated, upwardly extending, head gear-engaging tine 424 is fixed to rod 408 intermediate the ends thereof and extends upwardly between the legs 226, 228 and through an opening 426 in wall 110 into upper housing section 112. The upper end of tine 424 is configured to fit between adjacent teeth 180 on gear 176 so as to preclude rotation thereof; shifting of tine 424 rightwardly (see FIG. 17) permits rotation of this gear 176.

A second, elongated, transversely extending rod 428 is spaced forwardly from rod 408 and is parallel therewith. The rod 428 is supported for pivotal movement by means of spaced mounts 430, 432 secured to wall 108. A pair of upstanding arms 434, 436 are respectively secured to the opposed ends of rod 428 outboard of the mounts 430, 432. Each arm is provided with an outwardly extending, elongated operating element 438 or 440 which passes beneath the corresponding linkage arm 388 or 398 just rearward of and adjacent to the depending nib 392 or 402 thereon. A link 442 is secured to element 440 and extends forwardly for pivotal connection to pawl 372 adjacent the tooth-engaging end thereof.

The linkage arms 388, 398 are interconnected adjacent their forward ends by means of an elongated, transversely extending rod 444. The rod 444 is directly coupled to portion 404 of linkage arm 400 just forward of notch 405. On the other hand, the opposite end of rod 444 is pivotally coupled to a connector 446. This connector 446 is pivotal about a pin 448 supported on mount 450, and moreover pivots with the link 395.

A selectively operable hammer-disengaging mechanism 452 also forms a part of apparatus 30. This mechanism 452 includes an elongated shaft 454 pivotally supported by endmost mounts 456, 458 coupled to front wall 124. An upstanding tab 460 is secured to shaft 454 adjacent notch 405 on linkage arm 398. Further, a pair of rearwardly extending legs 462, 464 are connected to shaft 454 for pivoting therewith. The legs 462, 464 are disposed in straddling relationship to hammer cocking mechanism 254, and include inwardly extending operating ends 466 and 468 (see FIG. 19) which lie within the annular zone 266 between plates 258 and 264.

OPERATION

The mechanical operation of the above described printing apparatus 30 will next be discussed. In order to facilitate this description, the various operations of character printing, word spacing, tab spacing, back spacing and carriage return will be treated separately. Further, the discussion will assume the usual placement of a page 470 (see FIGS. 9 and 10) about platen 36, with housing 88 shifted to a starting position at the lefthand end of its path of travel. In this orientation mainspring 286 is fully coiled and energized. Also, at this initial rest position prior to character printing, tine 424 is in the forward, gear-engaging position thereof, pawl 372 is in engagement with a tooth on rachet wheel 370, and the solenoids 102, 104 are deenergized with their respective plungers 380, 382 extended. Furthermore, the position of band element 158 relative to printing aperture 134 is known by means of conventional position sensor 472 (FIG. 8) forming a part of the associated electrical control circuitry 500 and in cooperation with secondary, position-indicating apertures 164 in strip 160. (The sensor 472 extends through an appropriate opening in wall 110, and is not removed with housing 112.) That is to say, the particular character on band element 158 occupying the printing position adjacent aperture 134 is always known to the control circuitry 500, as through "counting" of the apertures 164 passing the sensor 472 after resetting of the counting function in response to passage of the indexing aperture 167 by a second position sensor 473.

1. Character Printing

Broadly speaking, character printing operations involve depression of a desired character key 50, whereupon band element 158 is rotated until the corresponding selected character assumes the printing position adjacent aperture 134. Hammer 220 is cocked and released in timed relationship with character selection to engage and distend the band element 158 through aperture 134 (along with the ribbon 182) for printing engagement with page 470. In this character printing operation, letterspacing is initiated simultaneously with commencement of band spin and hammer cocking, and the entire cycle is timed such that printing can occur only when proper letterspacing or translation down rack 310 has been achieved. The ratios of the gears of transmission and distribution means 96 is such that maximum head spin can be achieved in the time required for traversing a letterspacing distance. The apparatus 30 is thus capable of true "on the fly" printing and housing 88 need not actually come to a stop for printing purposes; this is highly advantageous when apparatus 30 is used as a machine printer.

In more detail, depression of a desired character key 50 first causes the control circuitry 500 to determine the appropriate direction of spin of band 158 in order to move the character body 166 corresponding with the depressed key to the printing position, as hereinafter explained. As noted above, band element 158 is bidirectionally shiftable (i.e., it can be shifted either clockwise or counterclockwise), so that the maximum distance of travel of band element 158 corresponds to a 180 degree arc on the band element. From a statistical standpoint however, the average distance of travel is much less, because of the known frequency of occurrence of letters in average texts; further, the characters are preferably cybernetically arranged on band 158 in a known manner in order to minimize the average distance of spin for a given printing cycle. In practice, approximately one-half of the band is devoted to lower case letters, numbers and punctuation, whereas the remaining portion of the band is devoted to upper case letters and other characters selected through use of the shift key and depression of a desired letter, number or punctuation key.

For purposes of the present discussion, it will be assumed that the shortest distance of spin to achieve proper character selection at printing aperture 134 can be achieved by counterclockwise motion. Such is assumed to have first been determined via circuitry 500, and an energization control signal is then delivered to solenoid 102, causing plunger 382 thereof to retract. Solenoid 104 remains unenergized. This in turn shifts linkage arm 388 forwardly towards wall 124. Upon such forward shifting, projection 390 engages element 420 and pivots tine rod 408 against the bias of spring 422. This has the effect of pivoting upright tine 424 leftwardly to its release position illustrated in FIG. 17. In this release position, the uppermost end of the tine is pulled out of engagement with the teeth 180 of gear 176.

Figure 15:
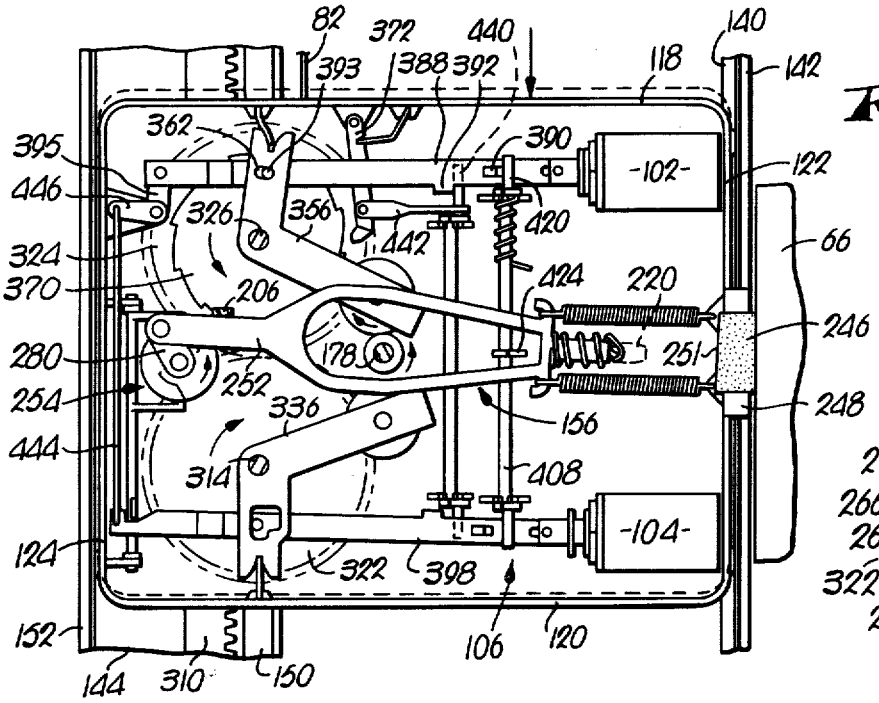
FIG. 15 is a view similar to that of FIG. 3 but illustrating the operation of the printing means during a character-printing cycle.

Depending nib 392 next engages the element 440 coupled to rod 428. This serves to pivot the rod 428 with the effect that pawl 372 is shifted via link 442 to a position out of engagement with ratchet wheel 370 (FIG. 15). Also, the interengagement of pin 393 and slot 362 serves to pivot link 356 in a clockwise direction. This in turn serves to translate planet gear 330 along the periphery of sun gear 324 until friction gear 354 comes into operative, force-transmitting engagement with central friction gear 368. Finally, the rearward shifting of linkage arm 388 serves to pull linkage arm 398 upwardly as viewed in FIG. 15, through the medium of link 395, connector 446, and rod 444.

Disengagement of pawl 372 and ratchet wheel 370 allows energy transmission and distribution means 96 to begin withdrawing energy from spring 286 for operational purposes. Specifically, when the pawl 372 is withdrawn from engagement with a ratchet tooth, the constant bias of mainspring 286 serves to rotate housing 288 which in turn rotates pinion 312 to begin shifting of carriage housing 88 rightwardly as viewed in FIG. 1 for letterspacing purposes. At the same time, energy is delivered through shaft 314 to sun gear 322, and the latter drivingly rotates sun gear 324 and ratchet wheel 370. This serves to rotate planet gear 330 and thereby friction gear 354. Inasmuch as the friction gear 354 has been shifted via link 356 into engagement with central friction gear 368, this gear likewise rotates. Rotation of friction gear 368 operates through shaft 178 to rotate band spin gear 176. Finally, the gear 176 serves to spin band element 158 in a counterclockwise direction.

Counterclockwise band spin continues until the desired character on the band element 158 reaches the printing position adjacent aperture 134. At this point the sensor 472, in conjunction with the control circuitry 500, deenergizes solenoid 102, whereupon plunger 382 thereof rapidly shifts rearwardly to the rest position thereof. This has the effect of allowing rod 408 to pivot back to its rest position under the influence of spring 422, so that tine 424 comes back into operative, movement-blocking position with the teeth 180 of gear 176, best seen in FIG. 6. This has the effect of stopping the rotation of gear 176, and thus the spinning of band element 158.

Forward shifting of the linkage arm 388 further allows pawl 372 to be shifted back to its original ratchet-engaging position through the medium of leaf spring 376. In this regard, the distance between the radial teeth on ratchet 370 is proportional with the distance to be traversed by housing 88 for a single letterspace, and the wheel 370 is sized such that band spin will be completed prior to rotation of the wheel 370 past the next adjacent radial tooth. Therefore, upon completion of band spin, pawl 372 will engage the arcuate surface leading to the next radially extending tooth edge. The pawl rides on this surface until the next adjacent radial tooth surface is reached, whereupon the ratchet 370 is stopped, along with energy transmission from mainspring 286 through the transmission and distribution means 96. Accordingly, it will be understood that the ratchet and pawl assembly effectively operates to permit withdrawal of only a limited quantum of potential energy from mainspring 286 for a given character printing or spacing cycle. The significance of this fact will be made clear hereinafter.

As noted above, initiation of head spin for character selection, and translation of housing 88 along rack 310, occurs substantially simultaneously through the transmission and distribution means 96. Furthermore, it will be appreciated that rotation of hammer gear 256 likewise occurs concurrently with headspin and translatory movement, inasmuch as gear 256 is coupled to pinion 312 through shaft 314 and sun gear 322. During counterclockwise rotation of hammer gear 256, two things occur. First, it should be understood that in the rest position of the hammer assembly, link 280 is in abutting engagement with one of the surfaces 274, 276 on cam plate 264. As rotation of gear 256 proceeds, link 280 is rotated through the abutment surface on plate 264 in a counterclockwise direction, thereby pulling tang 252 and hammer 220 forwardly. Such movement serves to extend and energize hammer springs 232, 234 (see FIG. 15), and continues until the link 280 reaches its over center position. At this point the bias of the springs 232, 234 rapidly pulls hammer 220 rearwardly towards aperture 134 for printing purposes. During such rearward movement, link 280 rides up and off the adjacent cam surface because of the continued rotation of gear 256 and plate 264 until the rest position of link 280 is again reached. Thus it will be seen that mechanism 254 serves to draw or cock the hammer during the printing cycle, and further that the printing energy imparted to the hammer from the springs 232, 234 is independent of the speed of translation of housing 88. As a result, equal energy is directed towards the page for printing purposes during each printing cycle.

During initial stages of hammer cocking, tang 252 comes into engagement with tab 206 forming a part of ribbon advancing assembly 184. By virtue of this engagement, the arm 204 is drawn upwardly as viewed in FIG. 8 in slot 208 against the bias of spring 216. Further, the camming action obtained via pin 214 and slot 212 causes the teeth 218 on block 210 to engage the ribbon 182 and pull the same in a clockwise direction around arcuate ribbon passageway 188. After the ribbon has been incrementally shifted in this manner, spring 216 serves to return block 210, and thus arm 204, back to the rest position illustrated in bold lines in FIG. 8. Such return to the rest position occurs prior to complete cocking and rearward travel of hammer 220.

From the foregoing description it will be appreciated that overall printing means 90 is characterized by the property of having different total motive energy requirements for operation thereof during different printing cycles. That is to say, the energy required for hammer cocking (and consequently advance of ribbon 182) is constant for each printing cycle, whereas the amount of energy required for character selection varies and depends upon the distance the band element must be rotated in any given instance.

Figure 20:
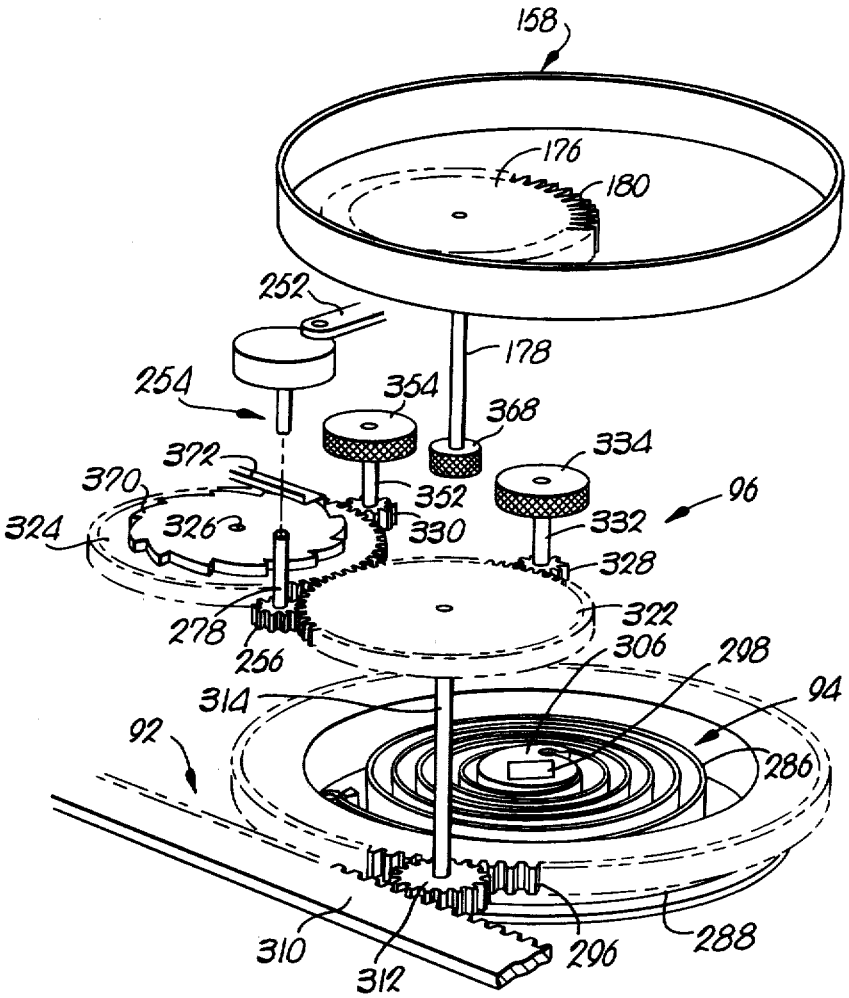
FIG. 20 is a schematic, exploded view illustrating the energy transmission and distribution structure of the invention.

The above consideration becomes important when it is realized that the limited increments of energy withdrawn from mainspring 286 for each printing cycle via the energy transmission and distribution means 96 and ratchet 370 and pawl 372 are always greater than the amount of energy needed to operate the printing means for band element spin and hammer cocking. An important feature of the present invention is that excess energy over and above that required for operation of the printing means per se is directly and instantaneously transferred to increase the speed of translation of the housing 88. Referring to FIG. 20, it will be seen that after the total energy requirement for the printing means 90 is determined (by the amount of headspin needed for character selection), substantially all of the remaining energy from the amount or quantum withdrawn is directed through pinion 312 for housing advancement (the sun gears 322, 324, planet gears 328, 352 and hammer gear 256 also rotate subsequent to cessation of headspin; nevertheless, these gears, with the possible exception of hammer gear 256, are not involved in energy transmission in this mode of operation).

The upshot of this operational characteristic is that carriage speed along ratchet 310 is variable between different printing cycles. Thus, if only minimal band element spin is required for character selection, speed of translation is increased. Conversely, if more substantial quantities of energy are consumed in band spin, the speed of translation is decreased. Further, it will be appreciated that energization of hammer 220 is independent of the speed of translation and/or any variations therein, so that printing characteristics are maintained constant regardless of translation speed.

Actual printing on page 470 occurs as follows. First, it will be understood that the respective gears making up energy transmission and distribution means 96 are sized such that the travel of hammer 220 towards page 470, and subsequent printing thereon, can occur only at the instant proper letterspacing has been achieved by translation of housing 88, or shortly thereafter. Thus, the possibility of overprinting between adjacent characters is eliminated. As hammer 220 is propelled rearwardly under the action of energized springs 232, 234 and guided by the interfitting of guide 236 and rod 238, it first engages the selected character body 166 positioned at the region of printing aperture 134. Inasmuch as the work end 222 of hammer 220, and the impact-receiving face 168 of the character body 166 are complementally configured, the work end tends to home in and center itself relative to the character body. Further rearward travel of hammer 220 serves to distend the flexible band element 158 outwardly through opening 134. Referring to FIG. 9, it will be seen that such distension of the band element 158 serves to engage and rearwardly distend or shift the flaps 130, 132. Further, by virtue of the relatively rigid nature of the character bodies 166 as opposed to the strip 160, considerable flexure occurs on opposite sides of the the character body being printed. Hence, the body being printed is pressed towards page 470 while the adjacent juxtaposed character bodies are bent forwardly at a significant angle relative to the body being printed. In this way the possibility of smearing or overprinting because of close spacing between the character bodies is eliminated. Again referring to FIG. 9, it will be seen that the ribbon 182 is distended outwardly with the band element 158 during the printing process. Thus the character face 170 of the selected body 166 is imprinted on page 470 through the medium of ribbon 182. During actual printing, hammer 220 contacts pad 246 and particularly face 251 thereof and thus an amount of impact energy is absorbed; in order to vary and limit the actual amount of impact energy delivered to page 470, pad 246 may be shifted laterally to increase or decrease the effective depth thereof at the printing position.

Figure 10:
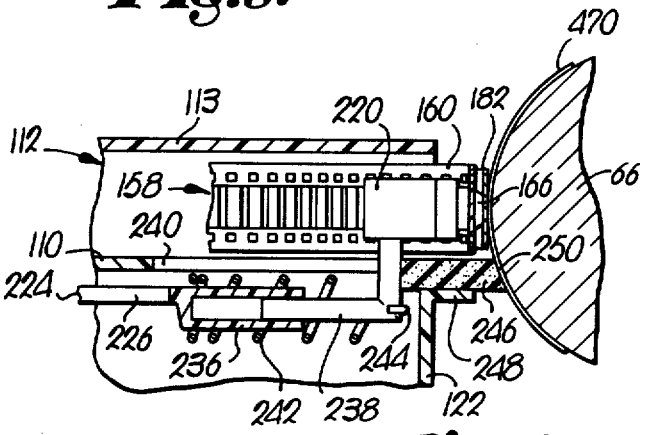
FIG. 10 is a sectional view taken along line 10—10 of FIG. 9 which further illustrates the construction of the character-bearing band and impact hammer.
Figure 11:
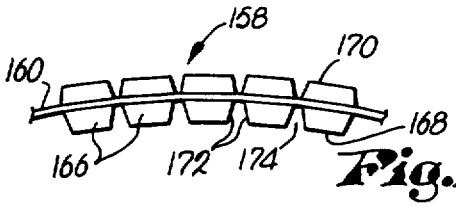
FIG. 11 is a fragmentary plan view of the distensible character-bearing band.

After the actual printing operation is completed, hammer 220 is returned to its original rest position under the influence of return spring 242 (FIG. 10). It will be understood in this regard that as hammer 220 was propelled rearwardly under the influence of springs 232, 234, return spring 242 was extended and energized. Thus, the hammer 220 is retracted forwardly by the spring 242 after character printing is completed. The band element 152 also returns to its original rest configuration after hammer 220 retracts. This occurs in part because of the shape-retaining nature of the synthetic resin strip 160, and more significantly because of the resilience of the flaps 130, 132 which tend to push the band forwardly to the original position thereof.

The foregoing discussion assumed that the position of the character to be printed vis-a-vis printing aperture 134 dictated counterclockwise rotation of band element 158. In the event that clockwise rotation of band element 158 is called for (such being determined by sensor 472 and the control circuitry 500), the following operation ensues. First, an energization control signal is directed to solenoid 104 in order to retract plunger 380 thereof, while solenoid 102 remains unenergized. Thus, linkage arm 398 is shifted rearwardly to accomplish the exact same functions hereinabove described when solenoid 102 is energized and linkage arm 388 shifted rearwardly. That is to say, rearward shifting of the linkage arm 398 serves to move tine 424 to the band-releasing position thereof of FIG. 17; to shift pawl 372 away from engagement with ratchet wheel 370 in order to begin withdrawal of a quantum of energy from mainspring 286 and corresponding rotation of flange gear 294, pinion 312, sun gears 322, 324, planet gears 328, 330 and hammer gear 256; to translate planet gear 332 such that friction gear 334 engages central friction gear 368 to thereby commence clockwise rotation of gear 176 and band element 158. Referring to FIG. 2, it will be observed that pin 403 normally is disposed within restricted arcuate region 346 of aperture 342, so that upon essentially rectilinear rearward shifting of the linkage arm 398, link 336 operates in the manner heretofore described with respect to link 356.

When character selection is completed, solenoid 104 is deenergized, and linkage arm 398 shifted rearwardly. This shifts tine 424 to its band-stopping position; and allows pawl 372 to reengage wheel 370 and stop operation of energy transmission and distribution means 96 when the pawl engages the next ratchet tooth.

In short, it will be seen that counterclockwise shifting of band element 152 is accomplished by energization of solenoid 102, whereas clockwise rotation is effected by energizing solenoid 104. In both cases the mechanical operation is essentially the same, save for the difference in band spin direction. Accordingly, no further discussion of clockwise band spin printing is believed necessary.

The fact that band 158 and related structure is spaced (at least about ⅛ inch) from page 470 ensures that the line of write will be visible at all times during printing. This is necessary for using apparatus 30 as a conventional typewriter.

The mechanical letterprinting operation of apparatus 30 is identical to that described above if the apparatus is used as a machine printer. In this mode of operation, remote input from a computer or phone coupling or the like replaces depression of letter keys 50, but in all mechanical respects the operation of apparatus 30 remains unchanged.

It will also be understood that after a given character printing operation is completed, the apparatus 30 is ready for the next character printing or spacing operation without additional mechanical operations. Specifically, tine 424 is in its movement-blocking position relative to band spin gear 176, the solenoids 102, 104 are ready for energization as appropriate, and the orientation of band element 158 vis-a-vis printing aperture 134 is sensed and determined. Therefore, additional character printing or spacing operations can proceed smoothly and essentially instantaneously.

2. Word Spacing

After a given word is typed on page 470, the operator will normally depress spacing bar 52 in order to translate housing 88 along rack 310 a letterspace distance.

Figure 18:
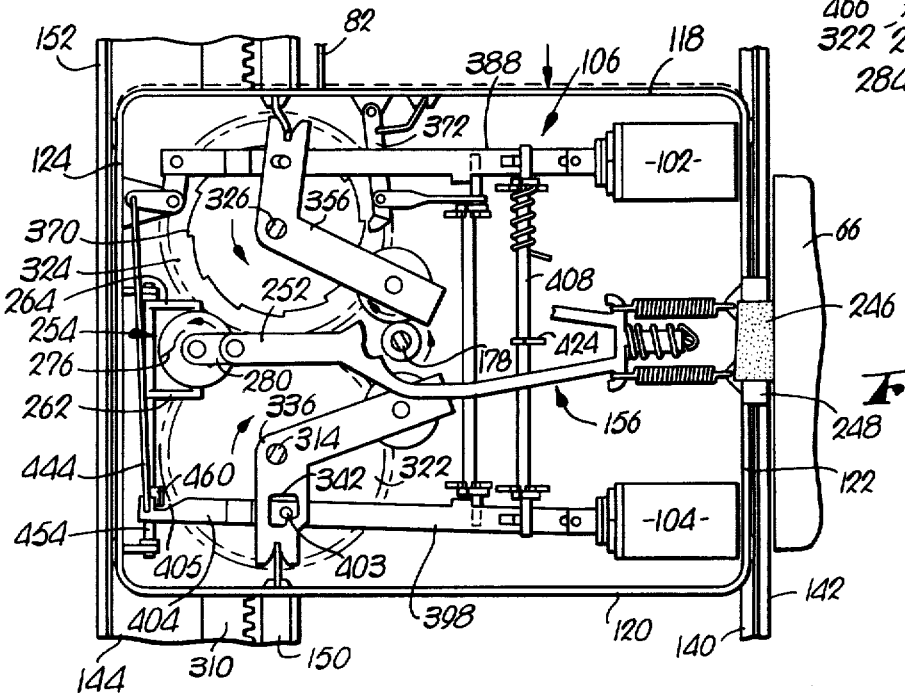
FIG. 18 is a fragmentary view similar to that of FIG. 15, but illustrating the operation of the printing means during letter or tab spacing cycles.

When the bar 52 is depressed, energization control signals are sent to both of the solenoids 102, 104, in order to energize the same. This has the effect of rearwardly shifting the respective linkage arms 388, 398 (FIG. 18). Simultaneous shifting of these linkage arms accomplishes many of the functions of character printing described above, but also brings hammer disengaging mechanism 452 into play so that no printing occurs on page 470. Further, the energy from spring 286 normally devoted to hammer cocking and ribbon advance is directed to increasing the translation speed of housing 88; thus, word spacing is extremely fast.

Figure 17:
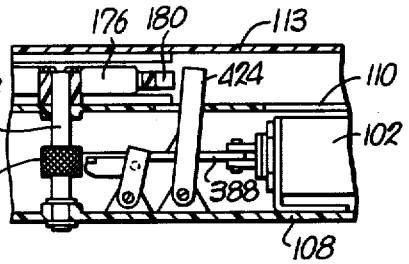
FIG. 17 is a fragmentary sectional view illustrating the orientation of the upright, movement-stopping tine in the release position thereof.

Specifically, rearward shifting of the linkage arms 388, 398 first rotates tine rod 408 via the projections 390, 400 and the associated elements 418, 420, so that tine 424 is shifted to its FIG. 17 release position. Pawl 372 is also withdrawn from engagement with ratchet wheel 370 by virtue of rotation of rod 428 through the medium nibs 392, 402 and the adjacent operating elements 438, 440.

The link 356 operatively coupled to the linkage arm 388 is pivoted in response to rearward movement of the linkage arm in the manner described above, in order to translate planet gear 330 and cause friction gear 354 to come into force-transmitting engagement with central friction gear 368. This in turn rotates shaft 178, gear 176 and band element 158. Finally, linkage arm 398 is pulled towards linkage arm 388 through link 395, connector 446, and rod 444. This serves to pull the rod 398 such that notch 405 thereof receives tab 460. Pulling of the linkage arm 398 towards arm 388 further serves to shift pin 403 into slot-like region 344 of aperture 342. In this orientation it will be observed (FIG. 18) that the pin 403 is ineffective to pivot the link 336. Thus planet gear 328 remains in its rest position and does not interfere with the rotation of central friction gear 368.

Although rearward shifting of link 398 does not, by virtue of the configuration of aperture 342, pivot the link 336 (when both solenoids 100, 102 are energized), it does initiate operation of the hammer disengaging mechanism 452. Specifically, referring to FIGS. 18–19, it will be seen that the notched portion 404 of linkage arm 398 engages the tab 460 with the effect that shaft 454 is pivoted axially. When this occurs, the respective legs 462, 464 are likewise pivoted in a downward direction. The operating ends 466, 468 of these legs thereby engage the upper surface of plate 258, with the effect that the gear 256, plate 258, body portion 262 and plate 264 are all shifted downwardly against the bias of coil spring 284. In this lowered, disengaged position (FIG. 19), the abutment surfaces 274, 276 on plate 264 are disposed beneath link 280. Therefore, the gear 256, plate 258, body portion 262, and plate 264 rotate beneath link 280 but do not engage the latter. Accordingly, when the mechanism 452 is in operation, no shifting or cocking of the hammer 220 occurs. Note in this respect that the width of gear 256 is greater than that of the associated sun gear 322; therefore the gear 256 can be shifted vertically relative to sun gear 322 without affecting the engagement between these gears.

In order to cease the spacing operation, the solenoids 102, 104 are deenergized in timed relationship with translation of housing 88. Deenergization effects forward shifting of the linkage arms 388, 398, and brings the entire mechanism back to its rest position for another printing cycle. Specifically, forward shifting of the arm 398 permits counterrotation of the legs 462, 464 and shaft 454 (such being caused by the bias of spring 284) so that the hammer cocking mechanism 254 returns to its FIG. 16 position. In addition, the linkage arm 398 is shifted laterally such that pin 403 returns to the restricted arcuate region 346 of aperture 342. Also, forward shifting of the linkage arms effects movement of planet gear 330 back to its FIG. 2 position through the medium of pin 393 and link 356.

3. Tab Spacing

Tab spacing is accomplished from a mechanical standpoint in exactly the same manner as the word spacing operation heretofore described. That is to say, in order to initiate tab spacing for a given distance along page 470, energization control signals are sent to solenoids 102, 104 for simultaneous operation thereof. When the appropriate distance has been spaced, the respective solenoids 102, 104 are deenergized.

During the period of energization of the solenoids, the mechanical functions described above with respect to word spacing obtain. Thus, tine 424 is in the release position thereof; pawl 372 is withdrawn from engagement with ratchet wheel 370; planet gear 330 is pivoted relative to sun gear 324 such that friction gear 354 engages central friction gear 368 for rotation thereof, and as a result gear 176 is rotated along with band element 158; and hammer disengaging mechanism 452 operates to disengage the hammer mechanism from transmission and distribution means 96, in order to prevent any movement of hammer 220.

It will be appreciated from the foregoing description that during tab spacing operations housing 88 is shifted under the constant bias of mainspring 286. Inasmuch as no energy is wasted in movement of hammer 220, a substantial portion of the energy withdrawn from mainspring 286 is transmitted directly to pinion 312 for increasing the speed of translation. However, it will also be appreciated that the speed of translation attained by housing 88 could be sufficient to actually damage or destroy the printing mechanism at the end of the tab spacing cycle. Accordingly, it is very desirable to govern the speed of translation during tab spacing. This is accomplished in the present invention by causing rotation of gear 176 and band 158 during tab spacing, as noted above. In effect, the gear and band element cooperatively present a rotatable airfoil element which limits the top speed attainable by housing 88 during tab spacing. As noted, without such a governing feature, potentially destructive speeds of translation are a possibility.

At the end of the tab spacing cycle, the solenoids 102, 104 are deenergized at the proper instant in order that pawl 372 comes into engagement with the arcuate surface of ratchet wheel 370 just ahead of the ratchet tooth corresponding to the end of the desired tab spacing. When the pawl 372 engages this tooth, energy ceases to be withdrawn from mainspring 286, the gear trains defining the transmission and distribution means 96 are stopped, and translation down rack 310 ceases.

The solenoids 102, 104 are in mechanical parallel during word or tab spacing and cooperatively define a mechanical control gate for such spacing. Thus, when one or the other of the solenoids is energized, the mechanical spacing gate is closed and printing occurs, but when both solenoids are energized, the spacing "gate" is opened and spacing can obtain.

4. Backspacing

If it is desired to backspace one or more letterspacing distances, key 62 is correspondingly depressed. This has the effect of energizing motor 80 through the control circuitry 500 in order to draw housing 88 leftwardly as viewed in FIG. 1. Incremental backspacing in this fashion occurs a letterspace at a time, in the usual manner. It will be appreciated that during such backspacing output spool 84 of motor 80 rotates in a clockwise direction in order to draw housing 88 leftwardly through the medium of cable 82. During backspacing however, no mechanical operations within housing 88 are underway, save for incremental rotation of housing 288 under the influence of cable 82; this of course has the effect of incrementally energizing the mainspring 286.

5. Carriage Return

When housing 88 reaches the end of a line of write on page 470, it is necessary to return the housing to its leftmost position for commencing another line of write. Depression of carriage return key 64 effects this shifting by causing energization of motor 80 and consequent clockwise rotation of spool 84. This has the effect of winding up cable 82 onto spool 84, and corresponding unwinding the cable from mainspring housing 288. This in turn serves to energize spring 286 so that the same has sufficient potential energy for accomplishing all line of write functions as the housing 88 again traverses page 470 going from left to right.

In view of the foregoing, it will be appreciated that motor 80 is activated only during backspacing and carriage return operations; it does not contribute any motive energy during character printing, word spacing or tab spacing. Those skilled in the art will thus appreciate that if it is desired to construct a wholly manual machine, means can be provided for manual carriage return with consequent energization of spring 286. It will also be readily understood that conventional, mechanical, paper advance or line feed mechanism and/or other known typewriter features and options can be mechanically or electrically incorporated into the apparatus of the present invention without departing from the principles thereof.

As in the case of printing, the functions of word spacing, tab spacing, backspacing and carriage return can all be controlled by signals from a computer or the like rather than from the keyboard 34. This alternative will be described in detail hereinafter.

After ribbon 182 is consumed during printing operations, the entire housing 112 is simply removed and discarded, and a replacement housing installed. Inasmuch as the housing 112 contains band 158 and ribbon advance mechanism 184, these components will likewise be replaced with the new ribbon. The simple, low cost nature of the band and related structure makes this a practical possibility. This feature also makes changeovers to different styles of type a simple matter, inasmuch as a replacement head assembly having a band element with different style characters thereon can be employed.

ELECTRICAL CONTROL

As those skilled in the art will appreciate, the general manner of accomplishing the control functions required for operation of the previously described, essentially mechanical apparatus constituting the thrust of this invention may utilize a variety of approaches relying in varying degrees upon mechanical, electromechanical and electronic techniques of largely or entirely conventional type. It will be further perceived that the particular manner of implementing various individual control functions, as well as whether or not certain optional functions are to be implemented at all, will depend in large measure upon the intended application for the previously described apparatus of this invention and the design preferences of the implementer. Accordingly, the purpose of FIG. 21 should be understood as primarily for illustrating exemplary approaches to the implementation of what might be regarded as a typical, basic set of control functions for the printing apparatus 30.

Figure 21:
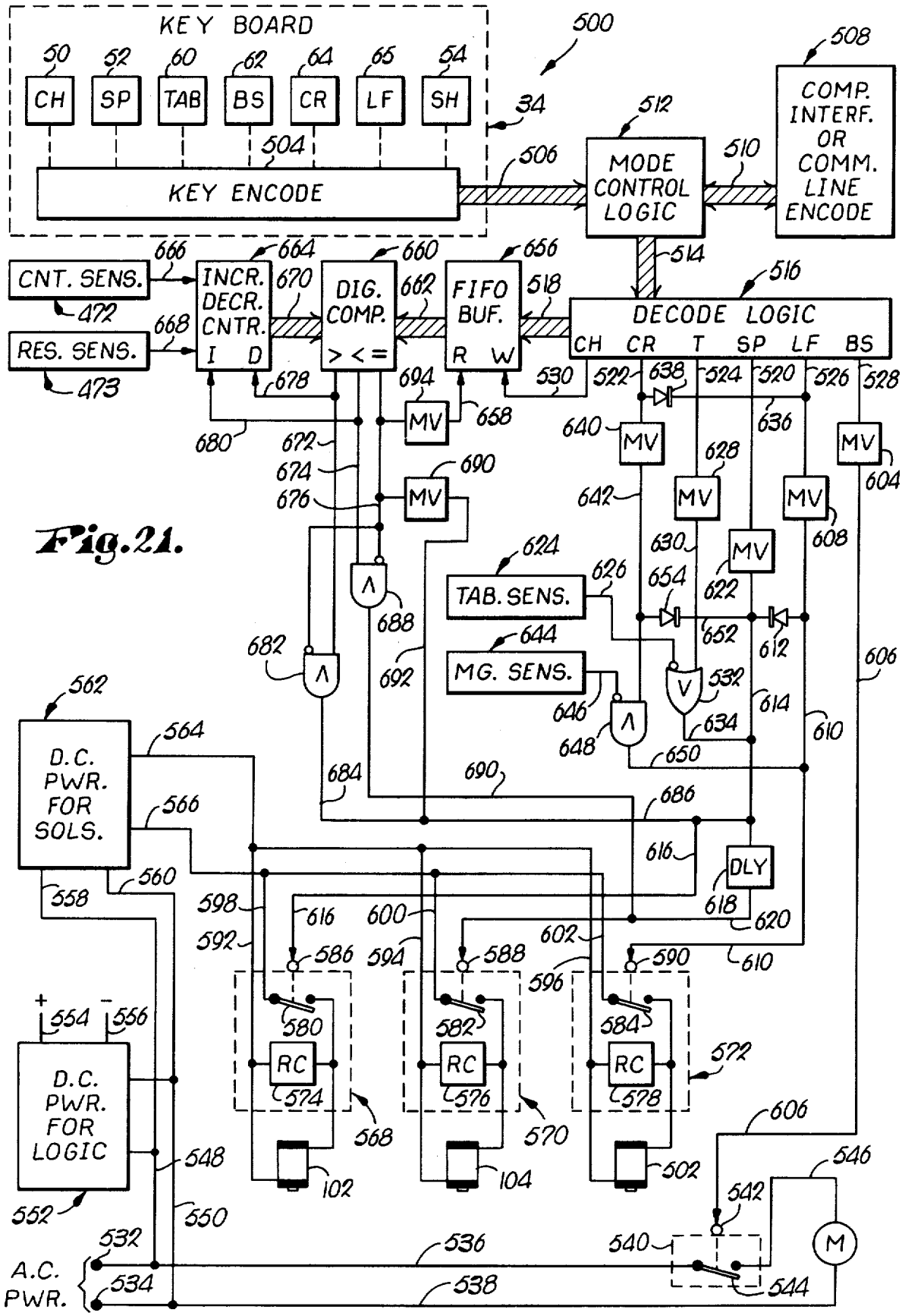
FIG. 21 is a diagram, partially in block form and partially in schematic form, illustrating an exemplary type of electrical circuitry for use with the invention.

In the control circuitry 500 depicted in FIG. 21, components previously mentioned in the foregoing description of the apparatus 30 may be identified at the outset as including the solenoids 102 and 104 and the motor 80, which are the primary components over which functional control is to be exercised consistently with their operation as previously described. The embodiment depicted in FIG. 21 also includes a third solenoid 502, which is preferably provided for implementations of the apparatus 30 intended for primary or alternate control from a computer, which will be understood is adapted upon actuation for operating a ratchet or other conventional mechanism (not shown) operably coupled with the platen 36 for incrementally rotating the latter to accomplish vertical paper advancement or line feed without the necessity of concurrently returning the carriage assembly 78 to the left margin as is normally inherent in typical carriage return controls. It should be understood, however, that the line feed solenoid 502 is optional and that paper advancement may be implemented with conventional, mechanical means which operate in response to the carriage return control, particularly in lower cost implementations of the apparatus 30 intended for use primarily as a typewriter.

It may also be helpful to next note the identity and general nature of the component assemblies from which control over the functioning of the motor 80, the solenoids 102 and 104 and the solenoid 502, if provided, will be exercised in a typical arrangement. Such control exercising aspect of the apparatus 30 will normally, although not mandatorily (as in a print only embodiment of the apparatus 30), include a keyboard 34 as previously described, which typically will have a plurality of character selection keys 50 (of which only one is shown in FIG. 21), a spacing bar key 52, a tab spacing key 60, a backspacing key 62, a carriage return key 64, a line feed key 65, and other control keys such as a shift key 54. The keyboard 34 can be constructed in various fashions in which each of the mentioned keys, for example, actuates an electrical switch, controls an electro-optically implemented matrix or the like. The keyboard 34 will also, however, typically include logic circuitry 504 of conventional type for accomplishing an electrical encoding of the actuation of any particular one of the mentioned keys into an electrical signal, which is unique to the actuation of that particular key, is represented by the binary bit values of a composite electrical signal having several bit "positions" (typically 7 or 8), and is output from the key encoding logic 504 upon an appropriate keyboard output line 506. Although the encoder 504 could be arranged to output the key representing signals in the form of a sequence of bit values in time sequenced or "serial" form, which would then typically be further encoded at an appropriate stage of the functional control into a plurality of bit values simultaneously available as concurrent electrical signals upon separate output lines in "parallel" form, current practice would favor encoding of the key signals into such simultaneous bit value, parallel for within the keyboard encoder 504 itself, and it will be assumed for purposes of further explanation that the keyboard output line 506 contains a plurality of conductors concurrently carrying, say, 7 bit values representing a conventional or other electrical encoding which is unique for each character and control function to be handled. One popular method of parallel encoding employing 7 bit values, which thereby provides 128 unique codes including an all "zero" null code and an all "one" null or "deleted" code, devotes 31 of the codes having the smallest binary number equivalent to control functions such as line feed, carriage return, backspacing, tabbing, etc., while the remaining 95 codes are used to represent a space and each of 94 printable characters respectively. For purposes of further explanation, such a code will be assumed for illustrative purposes.

Where the apparatus 30 is to be coupled with and subject to control from outside signal sources, as well as from the keyboard 34, the electrical signals for that purpose will normally come from either the interfacing circuitry within a computer or from a communications line associated with a computer, as broadly indicated by the block 508 in FIG. 21. When such signals are passed directly between computer interfacing circuitry and the apparatus 30, such is normally done by means of a multiconductor line 510 similar to the line 506 coupled with the output of the keyboard 34, and will be in the same parallel encoded form. The representation contemplated by the block 508 also includes, however, arrangements in which a telephone or other communications line may be intermediately utilized with the transmission of data thereover in serial form decoded and encoded at the opposite extremities of the communications line by so-called "modems", in which case it will be preferable that the block 508 be understood as including suitable encoding circuitry at some point adjacent the apparatus 30, so that communication with the rest of the apparatus 30 over line 510 can be assumed to be in the same parallel encoded form already assumed for the output of the keyboard 34 via the line 506.

Where both a keyboard 34 and a computer or remote data source 508 are to be utilized in a given system; the control circuitry 500 will preferably also include mode control logic circuitry 512 permitting selection of a desired operating mode in response to encoded commands received from either the keyboard 34 or the alternate data source 508 via the lines 506 and 510 respectively. Various operating modes may be provided for depending upon the nature of the desired application, including normal control over the printing apparatus 30 by the keyboard 34 but with output from the computer or other source 508 able to override the keyboard 34 and assume control over the printing apparatus 30 whenever information for printing becomes available from the source 508, or vice versa, as well as submodes in which the encoded output from the keyboard 34 is delivered only to the remainder of the control circuitry 500 or in which output from the keyboard 34 is either exclusively or also delivered to the computer or the like 508 via the line 510 (which is preferably bidirectional).

Regardless of whether encoded data to be printed is being accepted from the keyboard 34 or the alternate source 508, dependent upon the selected mode in which the mode control logic 512 is operating, the latter will deliver the multi-bit, encoded, parallel bit signal as an output upon a multi-conductor line 514, which is in turn coupled as the input to decoding logic circuitry 516. The decoding logic circuitry 516, which may be conventional in character (as is also true of the other componentry of the control circuitry 500), serves to separate out encoded signals representing valid codes for the various printable characters and to deliver those signals to the output line 518 in their parallel encoded form, to recognize an encoded signal validly representing a space and to produce in response thereto a direct current logic signal delivered to the single output line 520, to recognize encoded signals respectively representing carriage return, tabbing, line feed and backspacing commands and to produce in response thereto respective direct current logic signals delivered to the single output lines 522, 524, 526 and 528 respectively, to recognize and suppress from delivery to the remainder of the control circuitry 500 encoded signals representing commands or control functions not implemented in the particular system provided, and to generate and deliver to a single output line 530 an enabling logic signal representing the presence in the decode logic circuitry 516 of a new encoded parallel signal corresponding to a printable character ready to be processed (which enabling signal can conveniently be derived from ORing of the bit values from certain bit positions of the fully encoded multi-bit signal).

Before tracing the manner in which the control circuitry 500 may respond to the various ones of the mentioned output signals from the decode logic circuitry 516 to operate the motor 80, solenoids 102 and 104 and solenoid 502, if the latter is provided, it may be helpful to identify certain of the more mundane electrical and electronic components and circuitry which will preferably be conventionally associated with the controlled components 80, 102, 104 and 502. The terminals 532 and 534 represent connections to an AC power source line. The terminals 532 and 534 are respectively connected with the alternating current power leads 536 and 538, and the latter is in turn connected with one terminal of the motor 80. In order to provide for quick-acting energization and deenergization of the alternating current motor 80 in response to a typically low voltage, direct current, logic signal, some suitable form of electronic switching component 540, such as a Triac, is employed. The electronic switching component 540 has a control terminal 542 to which the mentioned type of logic signal may be selectively applied for controlling the operation of what is tantamount to a normally open switch 544 interposed between the alternating current power lead 536 and an extension 546 of the latter connected with the other terminal of the motor 80. When an appropriate, direct current, control signal is delivered to the terminal 542, the switch 544 is immediately closed to energize the motor 80 for operation, it being noted that a 40-watt, single phase, alternating motor having a capacitor start will suffice for the motor component 80 in typical implementations of the apparatus 30 and is found to provide the desired quick starting response upon "closure" of the Triac switch 544, as well as quick stopping of the motor component 80 when the Triac switch 544 is "reopened" upon withdrawal of the logic control signal from the terminal 542 of the switching device 540.

The alternating current power leads 536 and 538 are also respectively coupled by leads 548 and 550 with a preferably regulated, rectifying, power supply 552 for providing from its output leads 554 and 556 a source of relatively low (say, 5 volts), direct current operating power for the various, electronically implemented, logic components and associated circuitry included in the control circuit 500. For the sake of clarity in the drawing, the individual connections of such logic operating supply voltage to the various logic components are not individually shown, but the manner of connection thereof is conventional and will be apparent to those skilled in the art.

Respective extensions 558 and 560 of the AC power leads 548 and 550 energize a relatively low voltage (say, 24 volts), rectifying power supply 562 for providing operating power for the solenoids 102, 104 and 502 upon its output leads 564 and 566. The solenoids 102 and 104 are preferably of the quick-acting type having relatively low impedance windings such as, say, 32 ohms, while the solenoid 502 may be of a somewhat heavier duty type to provide the mechanical force required for ratcheting the platen 36. Preferably, each of the solenoids 102, 104 and 502 will be provided with conventional switching and driver circuitry as at 568, 570 and 572. Each of the drivers 568, 570 and 572 desirably may include a resistance-capacitance network as at 574, 576 and 578 respectively, coupled in shunt across the winding of the corresponding solenoid 102, 104 or 502 for the purpose of quickly "dumping" the solenoid winding circuit upon deenergization thereof, so that the involved solenoid 102, 104 or 502 will then be rapidly restored to its unactuated, standby condition. Each of the drivers 568, 570 and 572 also includes a transistorized or otherwise conventionally implemented electronic switch as at 580, 582, and 584 respectively, which are in turn controlled by control input terminals 586, 588 and 590 respectively. It will be understood that the electronic switches 580, 582 and 584 are normally "open", but are adapted to be immediately "closed" upon application of a direct current, logic, control signal to the corresponding control terminal 586, 588 or 590 and to immediately "reopen" upon the withdrawal of such control signal. As will be apparent from FIG. 21, the direct current power lead 564 is coupled by leads 592, 594 and 596 with one end of the winding of each of the solenoids 102, 104 and 502 respectively, while the power lead 566 is coupled via the leads 598, 600 and 602 respectively and the driver switches 580, 582 and 584 with the other end of the windings of the solenoids 102, 104 and 502. Thus, acutation and deactuation of each of the solenoids 102, 104 and 502 respectively is directly responsive to the application or withdrawal of a suitable direct current, logic, control signal at the corresponding driver switch control terminal 586, 588 or 590 respectively.

The basic operation of the mechanical components of the printing apparatus 30 to perform various functions in response to energization and deenergization of the motor 80 and the solenoids 102 and 104 have previously been described in general terms. It is believed, however, that understanding of certain more detailed aspects of the operation of the control circuitry 500 being described for illustrative purposes will be facilitated by considering the same in a somewhat different order than chosen for description of the mechanical operations above, and specifically by reserving discussion of the character printing function until the operation of the control circuitry 500 has been considered for certain of the less complex functions.

Accordingly, with respect to the backspacing function, it will be recalled that such function is actuated by the appearance upon the lead 528 of a logic control signal from the decode logic circuitry 516. Such signal is initially fed to a multivibrator 604, which responds by delivering to its output lead 606 a logic signal coupled to the control terminal 542 of the Triac electric switching device 540 for the motor 80. When such logic signal is present on the line 606, the switch 544 is "closed" and the motor 80 is energized during the duration of application of such logic signal to the terminal 542. The multivibrator 606 may be of the "one-shot" type adapted to deliver the mentioned control signal to the line 606 for a duration of about 50–100 milliseconds, during which the motor 80 will be briefly operated for a period suitable for backspacing the carriage assembly 78 by one character space. If desired, the multivibrator 604 may be implemented as of the "free-running" type, with a second "half-cycle" period equal to some suitably longer fraction of a second, in which case continued backspacing of the carriage assembly 78 may be effected by the operator of the keyboard 34 by retaining the backspace key 62 depressed until the desired backspacing distance has been covered.

We may next consider the optionally provided, separate line feed function, which is actuated by the delivery of a suitable logic signal to its output line 526 by the decode logic circuitry 516. The logic signal upon line 526 triggers a multivibrator 608 to deliver to its output line 610, and thereby to the control terminal 590 of the driver 572 associated with the line feed solenoid 502, a logic signal of suitable duration for causing the latter to ratchet or otherwise advance the platen 36 by one line in a vertical direction. The multivibrator 608 may be of the one-shot type, and a suitable period of the output signal delivered to the line 610 for paper advancement equal to one vertical line will typically be of the order of about one hundred milliseconds. If desired, the multivibrator 608 may be implemented as of the free-running type, with a second half-cycle duration of some suitably longer fraction of a second, whereupon continued depression of the line feed key 65 by the operator of the keyboard 34 will result in iterated line feed operations until the paper has been advanced the desired number of vertical lines.

An important auxiliary aspect of the line feed and several of the other functions is, as previously noted, the desirability of energizing the main solenoids 102 and 104 during periods of relative movement between the carriage assembly 78 and the paper carried by the platen 36, in order to positively disable the character printing mechanism during any such intervals. This is accomplished for the line feed function in the illustrative embodiment of FIG. 21 by coupling the line 610 through a diode or other isolating component 612 to a lead 614, which is in turn coupled both with a lead 616 connected to the driver switch control terminal 586 for the solenoid 102 and via a delay component 618 with a line 620 connected with the driver switch control terminal 588 for the solenoid 104. It is desirable for the mentioned purpose that the solenoid 102 be energized slightly prior to the energization of the solenoid 104, so that the delay component 618, which may be implemented in any conventional fashion, will provide a brief delay of the order of five milliseconds for energization of the solenoid 104 following energization of the solenoid 102. Such energization of the solenoids 102 and 104 is, of course, discontinued immediately upon the termination of the first half-cycle logic signal delivered by the multivibrator 608 to the line 610 and thereby to the driver control switch terminal 590 which controls operation of the line feed solenoid 502.

The spacing function may next be considered, and will be observed to be responsive to the presentation of a logic control signal by the decode logic circuitry 516 upon its output line 520. The signal upon line 520 is delivered to a multivibrator 622 having a first half-cycle period of the order of thirty milliseconds during which it delivers a logic signal to the previously mentioned line 614, which results in energization of the solenoid 102, followed by slightly delayed energization of the solenoid 104, and continuance of the energization of both of those solenoids during a period suitable for permitting the carriage assembly 78 to advance horizontally one character space to the right (say, about ten milliseconds). If the multivibrator 622 is of the one-shot type, only a single space advancement will occur; but, if the multivibrator 622 is implemented as of the free-running type with a second half-cycle period of some appropriately longer fraction of a second, then the operator of the keyboard 34 may effect iterated spacing operations by continued depression of the spacebar key 52.

Directing attention next to the tabbing function, which is activated by the presentation by the decoding logic circuitry 516 of a logic control signal upon its output line 524, it should first be mentioned that the tab sensing means 624 may be implemented in a variety of conventional fashions including optical-photoelectric sensing, direct electrical switching or, as preferred for convenience, the employment of tab position indicating magnets adjustably positionable along the width of the structure supporting the platen 36, with a Hall effect sensor then carried by the carriage assembly 78 for detecting whenever the latter horizontally moves into a position of alignment with any particular tab position, it being understood that the tab sensing means 624 will deliver an appropriate logic signal to its output line 626 whenever the carriage assembly 78 is positioned at or reaches a selected tab position. The initial logic signal upon line 524 is preferably delivered to a one-shot multivibrator 628 adapted to in turn deliver to its output line 630 a first half-cycle logic signal of relatively short duration sufficient merely to permit the carriage assembly 78 to advance away from any tab location upon which it may be setting at the time the tabbing function is invoked (a first half-cycle period of about ten milliseconds or a little more typically being sufficient for this purpose). Since the tabbing function may be desired to be invoked while the carriage assembly 78 is positioned at some selected tab location, with the sensing means 624 thus delivering a logic signal to its output line 26, it is necessary to provide for getting the tabbing movement of the carriage assembly 78 started even under that circumstance. This may be done by suitable logic circuitry such as an OR gate 632 having an invert input for the signal from line 626 and a non-invert input for the signal from line 630. The gate 632 delivers an appropriate logic signal through its output lead 634 to the previously mentioned lead 614 whenever the multivibrator 628 is delivering its logic signal to the line 630 or whenever the tab sensing means 624 is not delivering its logic signal representing positioning of the carriage assembly 78 at a selected tab location to the output line 626. Thus, the logic signal on line 630 from the multivibrator 626 will initiate tabbing of the carriage assembly 78 whether or not the latter is then setting upon a selected tab location; then, although the logic signal upon the line 630 from the multivibrator 628 terminates after the carriage assembly 78 has traversed about one character space or a little more, the tab sensing means 624 will not be producing a logic signal upon its output line 626 while the carriage assembly 78 is between selected tab locations, which the invert input to the gate 632 utilizes to continue its own logic output signal to the lines 634 and 614 until the carriage assembly 78 does reach the next selected tab location, whereupon the inversion of the logic signal from the line 626 causes the gate 632 to discontinue delivering a logic output signal to lines 634 and 614, so that the carriage assembly 78 will stop at such newly encountered tab location. It will also be observed, of course, that the application of the logic signal to the line 614 results in energization of the solenoid 102, and with a slight delay, the solenoid 104 during the tabbing operation, for the purposes previously noted (including the turning of the strip 160 serving as a "governor" to prevent undue speed of translation of the carriage assembly 78 during tabbing).

Next, the carriage return function is activated by the decode logic circuitry 516 delivering a logic control signal to its output lead 522. Presentation of the logic signal upon line 522 directly initiates two actions. First, it delivers a logic signal through the line 636 and an isolating diode or the like 638 to the line feed initiate line 526, thereby causing vertical advancement of the paper by one line in the manner previously described for the line feed function, it being noted that the multivibrator 608 will for this purpose preferably either be of the one-shot type or have a second half-cycle period sufficient to permit completion of the carriage return function without initiating a second line feed function. Secondly, the logic signal upon line 522 activates a one-shot multivibrator 640, which delivers to its output line 642 a logic signal of sufficient duration for completion of a normal carriage return operation. Left margin sensing means 644 may be implemented in any conventional manner, such as those previously mentioned for the tab sensing means 624, and operates to present to its output lead 646 a logic control signal only when the carriage assembly 78 is positioned in or returned to its leftmost marginal position (which may be adjustable through selective positioning of a portion of the sensing means 644). The sensing output line 646 is coupled through an invert input with an AND gate 648, and the line 642 from the multivibrator 640 is coupled as a non-inverting input to the gate 648. By virtue of the inversion of the logic signal from the margin sensing line 646, the gate 648 delivers a logic output to line 650 coupled with the line 606 that is effective to operate the electronic switching device 544 and energize the motor 80 whenever the multivibrator 640 is delivering a logic signal to its line 642 and the marginal sensing means 644 is indicating that the carriage 78 is not in its left marginal position and delivering no logic signal to its output line 646; however, when the carriage assembly 78 is at or has reacted its left marginal position, the inversion of the logic signal then presented to the line 646 causes the gate 648 to discontinue the delivery of any logic signal to its output line 650, thereby causing the motor 80 to remain or become deenergized. It will be noted that, even when the carriage return function is invoked with the carriage assembly 78 already at its left marginal position, a single line feed operation will nevertheless occur, as is desirable in most applications. It will also be observed that, when the carriage return function is invoked with the carriage assembly 78 displaced from its left marginal position, both the horizontal return operation and the single line feed operation will be occurring concurrently, which contributes to the overall speed of operation. As previously discussed in connection with the mechanical operation of the printing apparatus 30, it is desirable that the solenoids 102 and 104 be energized in their usual sequence and remain energized during the duration of a carriage return operation. This is provided for by means of a connection from the lead 642 to the lead 614 through a lead 652 preferably including an isolation diode or the like as at 654.

Finally, we reach the matter of character printing control by the control circuitry 500. The character designating code for the next character is delivered via the line 518 from the decode logic circuitry 516 to a first in first out type queing buffer 656 whenever the buffer 658 receives a logic signal via the line 530 for enabling the writing of the code for another character into the storage space provided by the buffer 656 (which preferably will provide storage for sufficient qued character codes to achieve rollover characteristics equivalent to 8 or more actuations of various character keys 50 or the equivalent input from an alternate data source 508). Whenever enabled to do so by a logic signal applied to its control input line 658, the buffer 656 makes available the next character code to a digital comparator 660 via a multiconductor line 662. Meanwhile, the count or position sensor 472 previously referred to (and which may preferably be implemented by conventional infrared or optical sensing components) for detecting the passage of apertures 164 as the strip 160 is moved will have been delivering and continue to deliver a logic signal for each such aperture passage to an incrementing and decrimenting counter 664 via a lead 666. Also, the reset position sensing means 473, which may be implemented similarly to the sensing means 472 but in a fashion to respond only to passage of the unique "zeroing" aperture 167, is adapted to deliver a logic signal for resetting the counter 664 via a lead 668 whenever the aperture 167 is passed. Although such resetting of the counter 664 is not theoretically necessary, it is desirable to assure that the count accumulated within the counter 664 and representing the position of the strip 160 will be maintained through frequent rechecking and resetting of the counter should that become appropriate. The count residing at any given time within the counter 664 and representing the current position of the strip 160 is presented to the digital comparator 660 on a continuing basis via the multi-conductor line 670.

The digital comparator 660 operates on a continuing basis to compare the binary or other numeric equivalent value of the character code being presented to it from the buffer 656 with the then current position indicating count from the counter 664 and is capable of determining whether the latter is greater than, less than or equal to the character code from the buffer 656. In a sophisticated implementation, it may be desirable to further speed overall printing operation if the digital comparator 660 is implemented in a way such that it will determine not only mere numeric differences between the inputs it is comparing, but will also take into account in generating "greater than" or "less than" output control signals whether it might, because of a "zero crossing", most quickly move the strip 160 in a direction not strictly corresponding to the pure numeric equivalent differences in the input signals being compared. That is, for example, the strip 160 might be most quickly repositionable for a character having a code of 125 with the band 160 currently positioned at a count of three by so controlling the movement of the strip 160 to be in a "greater than" direction, even though the numeric value of the count from counter 664 is "less than" the character code from the buffer 656. The comparator 660, can, of course, be so implemented through conventional techniques. For the sake of simplicity of present explanation, however, it may merely be understood that the comparator 660 will provide a logic signal upon one or the other of its output lines 672, 674 or 676 which respectively represent what may be referred to as a "greater than" sensing, a "less than" sensing or an equality sensing, the first two of which are to trigger movement of the strip 160 in an appropriate direction for positioning the character selected by the code from the buffer 656 in a position for printing thereof. The incrementing and decrementing counter 664 derives a control signal from the line 672 via a line 678 for causing the counter 664 to interpret count pulses from the sensor 472 in a decrementing sense when the comparator 660 is sensing a "greater than" relationship, and a signal for causing incrementing operation of the counter 664 may similarly be provided from the line 674 through a line 680. When the comparator 660 senses a "greater than" relationship, the logic signal upon line 672 will be delivered through an AND gate 682 and lines 684 and 686 to the line 616 for energizing the solenoid 102 until movement of the strip 160 has caused the count presented by the counter 664 to become equal to the character code being received by the comparator 660 from the buffer 656, whereupon the logic signal will disappear from line 672 and the solenoid 102 will be deenergized. In similar fashion, a logic signal upon the "less than" line 674 will be delivered through an AND gate 688 to a lead 690 connected to the line 620 for energizing the solenoid 104. Which of the solenoids 102 or 104 is energized, of course, determines the direction in which the band 160 will be moved to properly position the next character to be printed. When the comparator 660 senses equality such as when the band 160 is already positioned with a particular character in readiness for being reprinted, a logic signal will be applied to the line 676 that is delivered to an inverting input of each of the AND gates 682 and 688. Thus, such connections to the gates 682 and 688 assure that no logic signal representing equality will be present upon the line 676 during operation of the solenoid 102 or the solenoid 104 for repositioning of the strip 160. On the other hand, the presence of a logic signal upon the line 676 does actuate a one-shot multivibrator 690 for a brief period of the order of 5 milliseconds to briefly energize the solenoid 102 during that interval through a control path proceeding from the multivibrator 690 through a lead 692 and the lead 686 to the line 616. Since a sensing of equality by the comparator 660 does represent the achievement of proper positioning of the part 160 for the printing of the particular character which has been undergoing processing, the logic signal presented upon the line 676 to represent a sensing of equality if ultimately used to trigger a multivibrator 694, which in turn delivers a logic signal along the line 658 to the read enable of the buffer 656, so that the latter will then commence presenting the next stored character code to the comparator 660.

As with many details of the mechanical aspects of the embodiment disclosed for illustrating the invention, it will also be apparent that the implementation of the control circuitry 500 may be modified in a number of ways without departing from the real gist and essence of the invention involved in the printing apparatus 30. Accordingly, it is to be understood that this invention should be deemed limited only by the fair scope of the claims which follow, and that such claims should be interpreted so as to encompass a fair range of mechanical equivalents of the subject matter defined therein.

Having thus described the invention, what is claimed as new and desired to be secured by Letters Patent is:

1. Printing apparatus for sequentially printing a series of characters onto a proximal surface along a predetermined line of write, comprising:

printing structure including means for printing said characters, and means for causing relative translatory movement along said predetermined line of write between said printing means and said surface during operation of said apparatus, said printing means including an element having a series of characters thereon, means for shifting said element to sequentially position selected ones of said characters for printing thereof on said surface, and means for causing said selected characters to be sequentially printed on said surface, said printing means being characterized by the property of having different total motive energy requirements for operation thereof during different printing cycles, each of said printing cycles including operation of said movement-causing means to effect said relative translatory movement, operation of said element-shifting means to effect shifting of said element as necessary until a selected character is positioned for printing, and operation of said print-causing means to effect printing of the selected character on said surface; and coupling means comprising a source of motive energy selectively operably coupled to said element-shifting means and movement-causing means for supplying a limited amount of motive energy to the element-shifting means and movement-causing means during each printing cycle for operation thereof, said limited amount of energy being substantially constant for each printing cycle, said coupling means including energy distribution means for initially supplying respective portions of said limited motive energy amount to said element-shifting means and movement-causing means for concurrent operation thereof and until the total motive energy requirement of said element-shifting means for the printing cycle is supplied, and for thereafter supplying remaining energy of said limited amount to said movement-causing means in order to vary the speed of translation depending upon the magnitude of said energy portion used by said element-shifting means, said coupling means comprising mechanical linkage means for operably coupling said source of motive energy and said element-shifting means and movement-causing means respectively.

2. Apparatus as set forth in claim 1, said movement-causing means including a rack, and first gear means operably engaging said rack.

3. Apparatus as set forth in claim 2, said energy-supplying means comprising a potential energy-storing spring, and second gear means operatively coupled to said first gear means and spring.

4. Apparatus as set forth in claim 3, said distribution means comprising:

third gear means operably coupled between said first gear means and said element shifting means for shifting said element upon rotation of the first gear means; and fourth gear means operably coupled between said first gear means and said member shifting means for shifting of said member upon rotation of the first gear means.

5. Apparatus as set forth in claim 1, said printing means including spacing means for selectively decoupling said energy-supplying means from said printing means for effecting said relative translatory movement without printing on said surface.

6. Apparatus as set forth in claim 1, said print-causing means including an impact member and means for selectively shifting said impact member toward said element for printing of said selected characters on said surface.

7. Apparatus as set forth in claim 6, said impact member being located adjacent the same face of said surface as said element.

8. Apparatus as set forth in claim 1, said coupling means including structure operably coupling said source of motive energy to said print-causing means for operation of the print-causing means concurrently with operation of said element-shifting means.

9. Apparatus as set forth in claim 1, said source of motive energy comprising a potential energy-storing spring.

10. Printing apparatus for printing a series of characters onto a proximal surface, comprising:

printing means including a head assembly comprising a shiftable element having a series of characters thereon, and means for shifting of said element to position a desired one of said characters in a printing position proximal to said surface; and an impacting assembly comprising an impact member separate from said element and proximal thereto, and means for shifting said member against said element for causing said desired character to print upon said surface;

motive means;

means for translating said printing means along said surface;

means for operably coupling said motive means and said translating means;

means operably connecting said printing means to said translating means for said shifting of the element and impact member in response to and concurrently with translation of said printing means;

a control assembly, comprising shiftable element-stopping means movable between a first stop position in engagement with said head assembly for preventing movement of said element, and a second release position permitting element movement;

release means operably coupled with said connecting means for selectively permitting transfer of energy from said motive means, to said translating means for translation of said printing means, and through said connecting means for said shifting of the element and impact member;

means for sensing which of the characters of said element is at said printing position;

operating means for selectively moving said element-stopping means to said release position, for operating said release means to permit said energy transfer, and for return movement of the element-stopping means to said stop position; and control means operably coupled with said operating means and sensing means for initiating operation thereof to move said element-stopping means to said release position, and to operate said release means, upon selection of one of said characters to be printed on said surface, and for moving said element-stopping means to said stop position thereof when said element is shifted such that said selected character is in said printing position.

11. Apparatus as set forth in claim 10 wherein said translating means comprises an elongated rack, and first gear means operatively engaging said rack, said coupling means comprising second gear means operatively engaging said first gear means and coupled to said motive means for rotation of the second gear means thereby.

12. Apparatus as set forth in claim 11 wherein said connecting means comprises:

third gear means operably coupled between said first gear means and said element shifting means for shifting said element upon rotation of the first gear means; and fourth gear means operably coupled between said first gear means and said member shifting means for shifting of said member upon rotation of the first gear means.

13. Apparatus as set forth in claim 10, including spacing means comprising structure for selectively disconnecting said impacting assembly from said connecting means for allowing translation of said printing means without printing of a character onto said surface.

14. Apparatus as set forth in claim 10 wherein said motive means comprises an energy-storing spring.

15. Apparatus as set forth in claim 10 wherein said release means includes structure for transferring substantially equal quanta of energy from said motive means upon each operation of the release means.

16. Printing apparatus for printing a series of characters onto a proximal surface, comprising:

printing means including a head assembly comprising a shiftable element having a series of characters thereon, and means for shifting of said element to position any one of a number of said characters in a printing position proximal to said surface; and an impacting assembly comprising an impact member separate from said element and proximal thereto, and means for shifting said member against said element for causing said one positioned character to print upon said surface;

means for causing relative translatory movement between said element and said surface during operation of said apparatus;

structure including motive means operably coupled to said element-shifting means and movement-causing means for effecting said character positioning shifting of said element concurrently with said relative translatory movement;

shiftable element-stopping means movable between a first stop position in engagement with said head assembly for preventing movement of said element, and a second release position permitting element movement;

release means operably coupled with said structure for selectively permitting transfer of energy from said motive means, to said movement-causing means for causing said relative translatory movement, and to said element-shifting means for shifting of said element;

means for sensing the position of a selected one of said characters;

operating means for selectively moving said element-stopping means to said release position, for operating said release means to permit said energy transfer, and for return movement of said element-stopping means to said stop position; and control means operably coupled with said operating means and sensing means for initiating operation thereof to move said element-stopping means to said release position, and to operate said release means, in response to selection of one of said characters to be printed on said surface, and for moving said element-stopping means to said stop position thereof when said selected character is properly positioned.

17. Apparatus as set forth in claim 16, said coupling structure including means operably coupling said motive means and said member-shifting means for selective operation of the member-shifting means concurrently with said character positioning shifting of said element.

18. Printing apparatus for sequentially printing a series of characters onto a sheet along a predetermined line of write, comprising:

printing means including an element having a series of characters thereon, means for shifting said element to sequentially position selected ones of a number of said characters for printing thereof onto said sheet, an impact member separate from said element, means mounting said member adjacent said element and on the same side of said sheet as said element, means for shifting said member, at least a portion of said member shifting being in a printing direction for causing said selected characters to print upon said sheet, and means for stopping said element in order to sequentially stationarily position said selected ones of said characters at a position for impacting thereof by said impact member, said member-shifting means including means for biasing said member in said printing direction, mechanical withdrawing means for initially shifting said member in a direction opposite said printing direction and against the bias of said biasing means in order to build up potential energy in said biasing means, and mechanical release means for releasing said member from said withdrawing means after operation thereof in order to permit said member to shift in said printing direction for printing purposes and under the influence of said built up potential energy of said biasing means;

means for causing relative translatory movement along said predetermined line of write between said element and said sheet during operation of said apparatus;

motive means for selectively supplying an amount of motive energy;

an output component operably coupled with said motive means and movable in response to receiving said amount of energy from the motive means;

mechanical linkage means for selectively operably coupling said output component and at least two of said element-shifting means, member-shifting means and movement-causing means for transmitting said movement of said output component to said at least two coupled means for providing motive energy for initiating and sustaining operation of the two coupled means during each printing cycle, each of said printing cycles including operation of said movement-causing means to effect said relative translatory movement, operation of said element-shifting means to effect shifting of said element as necessary until a selected character is positioned for printing thereof onto said sheet, and operation of said member-shifting means to effect printing of said selected character onto said sheet;

means for sensing the position of at least one of said characters on said element, and for generating a corresponding operating signal in response to such sensing; and means operably coupled with said sensing means and said mechanical linkage means for operably coupling said output component and said at least two coupled means in response to said signal for selective, concurrent operation of the at least two coupled means during each printing cycle.

19. Apparatus as set forth in claim 18, said linkage means including linking structure for selectively operably coupling said output component with said movement-causing means and at least one of said element-shifting means and member-shifting means for selective, concurrent operation of said movement-causing means and said at least one coupled means during each printing cycle.

20. Apparatus as set forth in claim 18, said linkage means including linking structure for selectively operably coupling said output component with said movement-causing means, element-shifting means and member-shifting means for selective, concurrent operation of the coupled means during each printing cycle.

21. Apparatus as set forth in claim 18, said linkage means comprising a gear train.

22. Apparatus for printing a character on a surface, comprising:

printing structure including means for printing said character, and means for causing relative translatory movement along a predetermined line of write between said printing means and surface during operation of said apparatus, said printing means having a shiftable element with a series of print characters thereon, and means for shifting said element to position said character for printing on said surface;

a source of motive energy;

an output component operably coupled with said source and shiftable in response to withdrawal of energy from said source;

mechanical linkage means operably coupled to said component for transmitting mechanical operating motion in response to said shifting of the component, said linkage means including structure operably coupled to said movement-causing means for operation of the latter during and in response to said shifting of said component, said linkage means having additional means, including selectively movable coupling means, for selectively operably coupling the component and said element-shifting means for selectively transmitting motive energy from said source to said element-shifting means in order to operate the same and thereby shift the element, during and in response to said shifting of said component;

means operably coupled to said energy source for selectively withdrawing motive energy from the source to effect said shifting of said output component and consequent operation of said movement-causing means; and means operably connected to said movable coupling means for selectively moving the coupling means and thereby operably coupling said component and said element-shifting means for said transmittal of motive energy and concurrent operation of the movement-causing means and said element-shifting means during withdrawal of said motive energy from said source, and for thereafter selectively decoupling said component and said element-shifting means to discontinue transmittal of motive energy from said source to said element-shifting means and cease operation of the element-shifting means while operation of the movement-causing means continues whereby operation of the movement-causing means will continue after said decoupling and cessation of operation of said element-shifting means.

23. Apparatus as set forth in claim 22, said source of motive energy comprising a spring.

24. Apparatus as set forth in claim 22, said mechanical linkage means comprising a gear train.

25. Apparatus as set forth in claim 22, said movable coupling means comprising an arm and a gear carried by said arm, said connecting means including structure coupled to said arm for moving said gear between an operative position operably coupling said component and said part of said printing means, and a decoupling position wherein said component is decoupled from said element-shifting means.

* * * * *